US008199923B2

(12) United States Patent
Christoph

(10) Patent No.: US 8,199,923 B2
(45) Date of Patent: Jun. 12, 2012

(54) ACTIVE NOISE CONTROL SYSTEM

(75) Inventor: Markus Christoph, Straubing (DE)

(73) Assignee: Harman Becker Automotive Systems GmbH, Karlsbad (DE)

( * ) Notice: Subject to any disclaimer, the term of this patent is extended or adjusted under 35 U.S.C. 154(b) by 1175 days.

(21) Appl. No.: 12/015,219

(22) Filed: Jan. 16, 2008

(65) Prior Publication Data

US 2008/0181422 A1 Jul. 31, 2008

(30) Foreign Application Priority Data

Jan. 16, 2007 (EP) ..... 07000818

(51) Int. Cl.
*G10K 11/16* (2006.01)
*G10K 11/178* (2006.01)
*G10K 11/00* (2006.01)

(52) U.S. Cl. ..... 381/71.1; 381/73.1; 381/71.4; 381/71.11; 381/71.12

(58) Field of Classification Search ..... 381/71.1, 381/73.1, 71.4, 71.8, 71.9, 71.11, 71.12, 381/94.1, 94.2, 94.9; 704/200.1
See application file for complete search history.

(56) References Cited

U.S. PATENT DOCUMENTS

| | | | | |
|---|---|---|---|---|
| 4,757,443 | A | 7/1988 | Hecker et al. | |
| 5,105,377 | A | 4/1992 | Ziegler, Jr. | |
| 5,384,853 | A * | 1/1995 | Kinoshita et al. | 381/71.12 |
| 5,768,124 | A | 6/1998 | Stothers et al. | |
| 6,584,138 | B1 * | 6/2003 | Neubauer et al. | 375/130 |
| 6,594,365 | B1 * | 7/2003 | Eatwell | 381/73.1 |
| 7,050,966 | B2 * | 5/2006 | Schneider et al. | 704/200.1 |
| 7,302,062 | B2 * | 11/2007 | Christoph | 381/57 |
| 7,885,417 | B2 * | 2/2011 | Christoph | 381/71.11 |
| 2003/0198357 | A1 * | 10/2003 | Schneider et al. | 381/94.2 |
| 2005/0207583 | A1 * | 9/2005 | Christoph | 381/57 |
| 2006/0025994 | A1 * | 2/2006 | Christoph | 704/229 |
| 2006/0262938 | A1 * | 11/2006 | Gauger et al. | 381/56 |
| 2008/0137874 | A1 * | 6/2008 | Christoph | 381/57 |
| 2009/0034747 | A1 * | 2/2009 | Christoph | 381/71.4 |
| 2009/0074199 | A1 * | 3/2009 | Kierstein et al. | 381/71.6 |
| 2009/0086990 | A1 * | 4/2009 | Christoph | 381/71.12 |

FOREIGN PATENT DOCUMENTS

| | | |
|---|---|---|
| JP | 05011777 | 1/1993 |
| JP | 05313672 | 11/1993 |
| JP | 06274182 | 9/1994 |
| JP | 07032947 | 2/1995 |
| JP | 08339192 | 12/1996 |

OTHER PUBLICATIONS

E. Zwicker et al., "Psychoacoustics", Second Updated Edition, Springer, Berlin 1999, pp. 158-164.
E. Zwicker, "Subdivision of the Audible Frequency Range into Critical Bands", The Journal of the Acoustical Society of America, vol. 33, No. 2, p. 248, Feb. 1961.
Cioffi et al., "Adaptive Filtering," Handbook for Digital Signal Processing, Wiley & Sons, Inc., pp. 1085-1095, 1993.
Widrow et al.: "Adaptive Signal Processing", pp. 288-294, 1985.

* cited by examiner

*Primary Examiner* — Edgardo San Martin
(74) *Attorney, Agent, or Firm* — O'Shea Getz P.C.

(57) ABSTRACT

An active control of an unwanted noise signal at a listening site radiated by a noise source uses a reference signal that has an amplitude and/or frequency such that it is masked for a human listener at the listening site by the unwanted noise signal and/or a wanted signal present at the listening site in order to adapt for the time-varying secondary path in a real time manner such that a user doesn't feel disturbed by an additional artificial noise source.

38 Claims, 15 Drawing Sheets

| FIG. 13A |
|---|
| FIG. 13B |

ACTIVE NOISE CONTROL SYSTEM

CLAIM OF PRIORITY

This patent application claims priority to European Patent Application serial number 07 000 818.0 filed on Jan. 16, 2007.

FIELD OF THE INVENTION

The invention refers to active noise control (ANC), including active motor sound tuning (MST), in particular for automobile and headphone applications.

RELATED ART

Noise is generally the term used to designate sound that does not contribute to the informational content of a receiver, but rather is perceived to be interfering with the audio quality of a useful signal. The evolution process of noise can be typically divided into three areas. These are the generation of the noise, its propagation (emission) and its perception. It can be seen that an attempt to successfully reduce noise is initially aimed at the source of the noise itself—for example, by attenuation and subsequently by suppression of the propagation of the noise signal. Nonetheless, the emission of noise signals cannot be reduced to the desired degree in many cases. In such cases the concept of removing undesirable sound by superimposing a compensation signal is applied.

Known methods and systems for canceling or reducing emitted noise (ANC systems and methods) or undesirable interference signals—for example, through MST systems and methods, suppress unwanted noise by generating cancellation sound waves to superimpose on the unwanted signal, whose amplitude and frequency values are for the most part identical to those of the noise signal, but whose phase is shifted by 180 degrees in relation to the unwanted signal. In ideal situations, this method fully extinguishes the unwanted noise. This effect of targeted reduction in the sound level of a noise signal is often referred to as destructive interference.

The term 'noise' refers in this case both to external acoustic sound waves—such as ambient noise or the motion sounds perceived in the passenger area of an automobile—and to acoustic sound waves initiated by mechanical vibrations, for example, the passenger area or drive of an automobile. If the sounds are undesirable, they are also referred to as noise. Whenever music or speech is relayed via an electro-acoustic system in an area exposed to audio signals, such as the passenger space of an automobile, the auditory perception of the signals is generally impaired by the background noise. The background noise can be caused by effects of the wind, the engine, the tires, fan and other units in the car, and therefore varies with the speed, road conditions and operating states in the automobile.

So-called rear seat entertainment is becoming more and more popular in modern automobiles. This is offered by systems that provide high-quality audio signal reproduction and consequently demand greater consideration—or alternatively put—further reduction in the noise signals experienced. The option of focusing of audio signals toward individual persons is likewise demanded, normally through the medium of headphones. Known systems and methods therefore refer both to applications for the sonic field in the passenger area of an automobile and to transmission through headphones.

Particularly, it has to be considered the acoustics present in automobiles due to undesirable noise—for example, components emitting from the engine or exhaust system. A noise signal generated by an engine generally includes a large number of sinusoidal components with amplitude and frequency values that are directly related to the revolving speed of the engine. These frequency components comprise both even and odd harmonic frequencies of the fundamental frequency (in revolutions per second) as well as half-order multiples or subharmonics.

Thorough investigations have shown that a low, but constant noise level is not always evaluated positively. Instead, acceptable engine noises must satisfy strict requirements. Harmonic audio sequences are particularly favored. Since dissonance cannot be always excluded even for today's highly sophisticated mechanical engine designs, methods are employed to actively control engine noise in a positive manner. Methods of this kind are referred to as motor sound tuning (MST). To model the sonic behavior in these systems, for example, procedures are employed that use unwanted audio components for their cancellation at the source—for example, by a loudspeaker located in the intake duct of an engine for the acoustic cancellation signal. Methods are also known in which in a similar manner the sonic emission of the exhaust system of an automobile is modeled by the expunction of unwanted noise components.

Active noise control methods and systems for noise reduction or sonic modeling are becoming increasingly more popular, in that modern digital signal processing and adaptive filter procedures are utilized. In typical applications, an input sensor—for example, a microphone—is used to derive a signal representing the unwanted noise that is generated by a source. This signal is then fed into the input of an adaptive filter and reshaped by the filter characteristics into an output signal that is used to control a cancellation actuator—for example, an acoustic loudspeaker or electromechanical vibration generator. The loudspeaker, or vibration generator, generates cancellation waves or vibrations that are superimposed on the unwanted noise signals or vibrations deriving from the source. The observed remaining noise level resulting from the superimposition of the noise control sound waves on the unwanted noise is measured by an error sensor, which generates a corresponding error feedback signal. This feedback signal is the basis used for modification of the parameters and characteristics of the adaptive filter in order to adaptively minimize the overall level of the observed noise or remainder noise signals. Feedback signal is the term used in digital signal processing for this responsive signal.

A known algorithm that is commonly used in digital signal processing is an extension of the familiar Least Mean Squares (LMS) algorithm for minimization of the error feedback signal: the so-called Filtered-x LMS algorithm (FxLMS, cf. WIDROW, B., STEARNS, S. D. (1985): "Adaptive Signal Processing." Prentice-Hall Inc., Englewood Cliffs, N.J., USA. ISBN 0-13-004029-0). To implement this algorithm, a model of the acoustic transfer function is required between the active noise control actuator—in the case presented here, a loudspeaker —and the error sensor, in this case, a microphone. The transfer path between the active noise control actuator and the error sensor is also known as the secondary or error path, and the corresponding procedure for determining the transfer function as the system identification. In addition, an additional broadband auxiliary signal—for example, white noise, is transferred from the active noise control actuator to the error sensor using state-of-the-art methods to determine the relevant transfer function of the secondary path for the FxLMS algorithm. The filter coefficients of the transfer function of the secondary path are either defined when starting the ANC system and remain constant, or they are adaptively adjusted to the transfer conditions that change in time.

A disadvantage of this approach is that the specified broadband auxiliary signal can be audible to the passengers in an automobile, depending on the prevailing ambient conditions. The signal can be perceived to be intrusive. In particular, an additional auxiliary signal of this kind will not satisfy the high demands placed on the quality (least possible noise) of the interior acoustics and audio signal transmission for rear seat entertainment in high-value automobiles.

It is a general need to provide a method and system which enable a test signal inaudible to human passengers (and therefore unobtrusive) in an automobile that is used to determine the transfer function of the secondary path required for the FxLMS algorithm.

SUMMARY OF THE INVENTION

An active noise control system comprises a loudspeaker for radiating a cancellation signal to reduce or cancel unwanted noise signal. The cancellation signal is transmitted from a loudspeaker to the listening site via a secondary path. An error microphone at the listening site for determining through an error signal the level of achieved reduction. A first adaptive filter generates the canceling signal by filtering a signal representative of the unwanted noise signal with a transfer function adapted to the quotient of the primary- and the secondary path ($W(z)=P(z)/S(z)$) transfer function using the signal representative of the unwanted noise signal and the error signal from the error microphone. A reference generator generates a reference signal which is supplied to the loudspeaker together with the canceling signal from the first adaptive filter; the reference signal has such an amplitude and/or frequency that it is masked for a human listener at the listening site by the unwanted noise signal and/or a wanted signal present at the listening site.

A method for active control of an unwanted noise signal at a listening site radiated by a noise source where the unwanted noise is transmitted to the listening site via a primary path having a primary path transfer function comprises the steps of: radiating a cancellation signal to reduce or cancel the unwanted noise signal; the cancellation signal is transmitted from a loudspeaker to the listening site via a secondary path; determining through an error signal the level of achieved reduction at the listening site; first adaptive filtering for generating the canceling signal by filtering a signal representative of the unwanted noise signal with a transfer function adapted to the quotient of the primary- and the secondary path ($W(z)=P(z)/S(z)$) transfer function using the signal representative of the unwanted noise signal and the error signal; and generating a reference signal which is supplied to the loudspeaker together with the canceling signal from the first adaptive filtering step; the reference signal has an amplitude and/or frequency such that it is masked for a human listener at the listening site by the unwanted noise signal and/or a wanted signal present at the listening site.

DESCRIPTION OF THE DRAWINGS

The invention can be better understood with reference to the following drawings and description. The components in the figures are not necessarily to scale, instead emphasis being placed upon illustrating the principles of the invention. Moreover, in the figures, like reference numerals designate corresponding parts. In the drawings.

DETAILED DESCRIPTION

A feedforward control system is usually applied if a signal correlated with the unwanted noise to be reduced is used to drive the active noise control actuator (e.g., a loudspeaker in this case). In contrast, if the system response is measured and looped back, a feedback process is usually applied. Feedforward systems typically exhibit greater effectiveness in suppressing or reducing noise than feedback systems, particularly due to their ability of broadband reduction of noise. This is because feedforward systems enable noise to be prevented by initiating counteractions against evolving noises by evaluating the development of the noise signal. Feedback systems wait for the effects of noise to first become apparent before taking action. Active noise control does not take place until the sensor determines the noise effect. The advantage of feedback systems is that they can also operate effectively even if there is no signal correlated with the noise that can be used for control of the ANC system. For example, this applies to the use of ANC systems for headphones in which the headphones are worn in a space whose noise behavior is not previously known. Combinations of feedforward and feedback systems are also used in practical applications to obtain a maximum level of noise reduction. Systems of this kind are referred to hereafter as hybrid systems.

Practical applications of feedforward control systems for active noise control are commonly adaptive in nature because the noise to reduce is typically subject to timing alterations in its sound level and spectral composition due to changing ambient conditions. In the example regarded here in automobiles, such changes in ambient conditions can be due to different driving speeds (e.g., wind noises, revolving tire noises), different load states of the engine, an open window and so on.

It is known that a desired impulse response or transfer function of an unknown system can be adequately approximated using adaptive filters in a recursive method. Adaptive filters generally refer to digital filters implemented with the aid of algorithms in digital signal processors, that adapt their filter coefficients to the input signal in accordance with the applicable algorithm. The unknown system in this case is assumed to be a linear, distorting system whose transfer function has to be determined. To find this transfer function, an adaptive system is connected in parallel to the unknown system.

Figure 1:
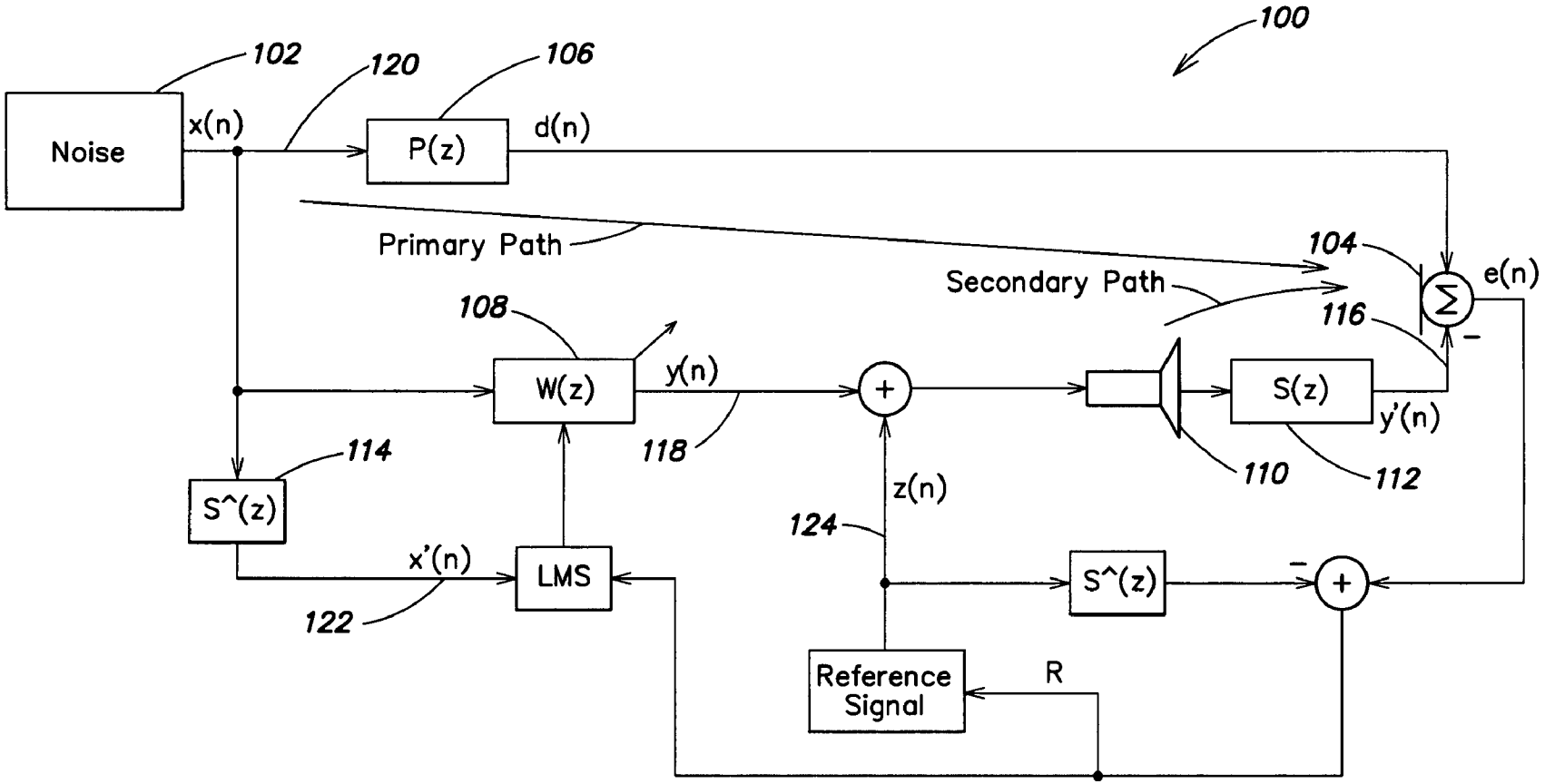
FIG. 1 is a block diagram of a system according to an aspect of the present invention.

The so-called filtered-x LMS (FxLMS) algorithm is very often used in such cases, or variations of it. The structure of the filtered-x LMS algorithm is shown in FIG. 1, which illustrates the block diagram of a typical digital ANC system 100 that employs the filtered-x LMS (FxLMS) algorithm. For the sake of simplification, other components needed to actually realize such a system, such as amplifiers and analog-to-digital or digital-to-analog converters, are not shown here.

The system of FIG. 1 comprises a noise source 102, an error microphone 104 and a primary path 106 of the sonic transfer from the noise source 102 to the error microphone 104 with the transfer function P(z). The system of FIG. 1 also includes an adaptive filter 108 with a transfer function W(z), a loudspeaker 110 for generating the noise control soundwaves and a secondary path 112 describing the sonic transfer from the loudspeaker 110 to the error microphone 104 with the transfer function S(z). Also included in the system of FIG. 1 is a filter 114 with the transfer function Ŝ(z) which is estimated from the secondary path function S(z) using the system identification method. The filter 114 is connected upstream of a function block LMS for the Least Mean Square algorithm for adaptive adjustment of the filter coefficients of the adaptive filter 108. The LMS algorithm is an algorithm for approximation of the solution of the known least mean square problem. The algorithm works recursively—i.e., with each new data set the algorithm is rerun and the solution updated. The LMS algorithm offers a low degree of complexity and associated computing power requirements, numerical stability and low memory requirements.

The filtered-x LMS algorithm also has the advantage that it can be implemented, e.g., in a digital signal processor, with relatively little computing power. Two test signals are required as input parameters for the implementation of the FxLMS algorithm: a reference signal x(n), e.g., directly correlated with an external noise that affects the system, and an error signal e(n) that, e.g., is composed of the superimposition of the signal d(n) induced by the noise x(n) along the primary path P having a transfer function P(z), and a signal y'(n) on a line 116, which is obtained from the actuating signal y(n) through the loudspeaker 110 and the secondary path 112 with the transfer function S(z) at the location of the error sensor. The actuating signal y(n) on line 118 derives from filtering of the noise signal x(n) on line 120 with the adaptive filter 108 having the transfer function W(z). The name "filtered-x LMS" algorithm is based on the fact that not the noise x(n) directly in combination with the error signal e(n) is used for adaptation of the LMS control, but rather signal x'(n) on line 122 filtered with the transfer function Ŝ(z) of filter 114, in order to compensate for the decorrelation, in particular between a broadband error signal x(n) and the error signal e(n), that arises on the primary path 106 from the loudspeaker 110 to the error sensor 104, (e.g., a microphone).

IIR (Infinite Impulse Response) or FIR (Finite Impulse Response) filters are used as filters for the transfer functions W(z) and Ŝ(z). FIR filters have a finite impulse response and work in discrete time steps that are usually determined by the sampling frequency of an analog signal. An n-th order FIR filter is defined by the differential equation:

$$y(n) = b_0 * x(n) + b_1 * x(n-1) + b_2 * x(n-2) + \ldots + b_N * x(n-N) = \sum_{i=0}^{N} bi * x[n-i]$$

where y(n) is the output value at the time n, and is calculated from the sum of the last N sampled input values x(n-N) to x(n), for which the sum is weighted with filter coefficients $b_i$. The desired transfer function is realized by specification of the filter coefficients $b_i$ (i=0, 1 . . . N).

Unlike FIR filters, output values that have already been computed are included in the analysis for IIR filters (recursive filters) having an infinite impulse response. Since the computed values can be very small after an infinite time, however, the computation can be interrupted in practice after a finite number of sample values n. The calculation scheme for an IIR filter is:

$$y(n) = \sum_{i=0}^{N} b_i * x(n-i) - \sum_{i=0}^{M} a_i * y(n-i)$$

where y(n) is the output value at the time n, and is calculated from the sum of the sampled input values x(n) weighted with the filter coefficients $b_i$ added to the sum of the output values y(n) weighted with the filter coefficients $a_i$. The desired transfer function is again realized by specification of the filter coefficients $a_i$ and $b_i$.

In contrast to FIR filters, IIR filters can be unstable here, but have greater selectivity for the same level of expenditure for their implementation. In practical applications the filter that best satisfies the relevant conditions under consideration of the requirements and associated computation is chosen.

A disadvantage of the simple design of the filtered-x LMS algorithm as shown in FIG. 1 is that the quality of the system identification of the secondary path depends on the audio properties—for example, the sound level, bandwidth and spectral distribution of the actual noise signal x(n). This has the effect in practical terms that the system identification of the secondary path is only carried out in narrowband and that additional noise components at the site of the desired noise cancellation, that are not contained in the noise x(n) dependent on the site of the determination of that noise x(n), are not considered by the filtered-x LMS algorithm. To conform with the causality condition, the site for determining the noise signal x(n) is located such that the resulting sonic propagation time corresponds to at least the period needed to compute the noise control signal for the loudspeaker 110. In practice a reference signal independent of the noise signal x(n) is generally used for system identification. This reference signal is added at a suitable position to the filtered-x LMS algorithm. This is illustrated schematically by reference signal z(n) on line 124 in FIG. 1, which is added before the loudspeaker 110 to the actuating signal for the noise control y(n), and which is used for system identification of the secondary path 112. In this case, the signal y'(n) on the line 116 at the error microphone 104 is obtained from the transfer of the sum of the actuating signal for the noise control y(n) and the reference signal z(n) using the transfer function S(z) of the secondary path. It is desirable here that the system identification—i.e., the determination of the transfer function S(z) of the secondary path 112, be carried out with a signal with the largest possible bandwidth. As described above, a disadvantage of this approach is that this specified reference signal z(n) can be perceived to be intrusive for passengers in an automobile, depending on the prevailing ambient conditions.

The present invention seeks that the required reference signal z(n) for system identification of the secondary path 112 be produced in such a way that it is inaudible to the vehicle's passengers, taking the applicable noise level and its timing characteristics and spectral properties in the interior of an automobile or for headphones into consideration. To achieve this, physical variables are no longer exclusively used. Instead, the psychoacoustic properties of the human ear are taken into account.

Psychoacoustics deals with the audio perceptions that arise when a soundwave encounters the human ear. Based on human audible perceptions, frequency group creation in the inner ear, signal processing in the human inner ear and simultaneous and temporary masking effects in the time and frequency domains, a model can be produced to indicate what acoustic signals or what different combinations of acoustic signals are audible and inaudible to a person with normal hearing in the presence of noises. The threshold at which a test tone can be just heard in the presence of a noise (also known as a masker) is referred to as the masked threshold. In contrast, the minimum audible threshold is the term used to describe the threshold at which a test tone can just be heard in a completely quiet environment. The area between minimum audible threshold and masked threshold is known as the masking area.

The method described below uses psychoacoustic masking effects, which are the basis for the method of active noise control, particularly for generation of the reference signal z(n) on the line 124, which is inaudible to the passengers in the interior of an automobile as intended by the invention, depending on the existing conditions in the passenger area. The psychoacoustic masking model is used to generate the reference signal z(n). In this way, the system identification of the secondary path 106 is performed adaptively and is adjusted in real-time to changes in noise signals. As the noise signals in an automobile, that in accordance with the invention lead to masking (i.e., inaudibility of the reference signal z(n)), are subject to dynamic changes, both in regard to their spectral composition and to their timing characteristics, a psychoacoustic model considers the dependencies of the masking of the sonic level, of the spectral composition and of the timing.

The basis for the modeling of the psychoacoustic masking is fundamental properties of the human ear, particularly of the inner ear. The inner ear is located in the so-called petruous bone and filled with incompressible lymphatic fluid. The inner ear is shaped like a snail (cochlea) with approximately 2½ turns. The cochlea in turn comprises parallel canals, the upper and lower canals separated by the basilar membrane. The organ of Corti rests on the membrane and contains the sensory cells of the human ear. If the basilar membrane is made to vibrate by soundwaves, nerve impulses are generated—i.e., no nodes or antinodes arise. This results in an effect that is crucial to hearing—the so-called frequency/location transformation on the basilar membrane, with which psychoacoustic masking effects and the refined frequency selectivity of the human ear can be explained.

The human ear groups different soundwaves that occur in limited frequency bands together. These frequency bands are known as critical frequency groups or as critical bandwidth (CB). The basis of the CB is that the human ear compiles sounds in particular frequency bands as a common audible impression in regard to the psychoacoustic hearing impressions arising from the soundwaves. Sonic activities that occur within a frequency group affect each other differently than soundwaves occurring in different frequency groups. Two tones with the same level within the one frequency group, for example, are perceived as being quieter than if they were in different frequency groups.

As a test tone is then audible within a masker when the energies are identical and the masker is in the frequency band whose center frequency is the frequency of the test tone, the sought bandwidth of the frequency groups can be determined. In the case of low frequencies, the frequency groups have a bandwidth of 100 Hz. For frequencies above 500 Hz, the frequency groups have a bandwidth of about 20% of the center frequency of the corresponding frequency group.

If all critical frequency groups are placed side by side throughout the entire audible range, a hearing-oriented non-linear frequency scale is obtained, which is known as tonality and which has the unit "bark". It represents a distorted scaling of the frequency axis so that frequency groups have the same width of exactly one bark at every position. The non-linear relationship between frequency and tonality is rooted in the frequency/location transformation on the basilar membrane. The tonality function was defined in tabular and equation form by Zwicker (see Zwicker, E.; Fastl, H. Psychoacoustics-Facts and Models, 2nd edition, Springer-Verlag, Berlin/Heidelberg/N.Y., 1999) on the basis of masked threshold and loudness examinations. It can be seen that in the audible frequency range from 0 to 16 kHz exactly 24 frequency groups can be placed in series so that the associated tonality range is from 0 to 24 barks.

Moreover, the terms loudness and sound intensity refer to the same quantity of impression and differ only in their units. They consider the frequency-dependent perception of the human ear. The psychoacoustic dimension "loudness" indicates how loud a sound with a specific level, a specific spectral composition and a specific duration is subjectively perceived. The loudness becomes twice as large if a sound is perceived to be twice as loud, which allows different soundwaves to be compared with each other in reference to the perceived loudness. The unit for evaluating and measuring loudness is a sone. One sone is defined as the perceived loudness of a tone having a loudness level of 40 phons—i.e., the perceived loudness of a tone that is perceived to have the same loudness as a sinus tone at a frequency of 1 kHz with a sound pressure level of 40 dB.

In the case of medium-sized and high intensity values, an increase in intensity by 10 phones causes a two-fold increase in loudness. For low sound intensity, a slight rise in intensity causes the perceived loudness to be twice as large. The loudness perceived by humans depends on the sound pressure level, the frequency spectrum and the timing characteristics of the sound, and is also used for modeling masking effects. For example, there are also standardized measurement practices for measuring loudness according to DIN 45631 and ISO 532 B.

Figure 2:
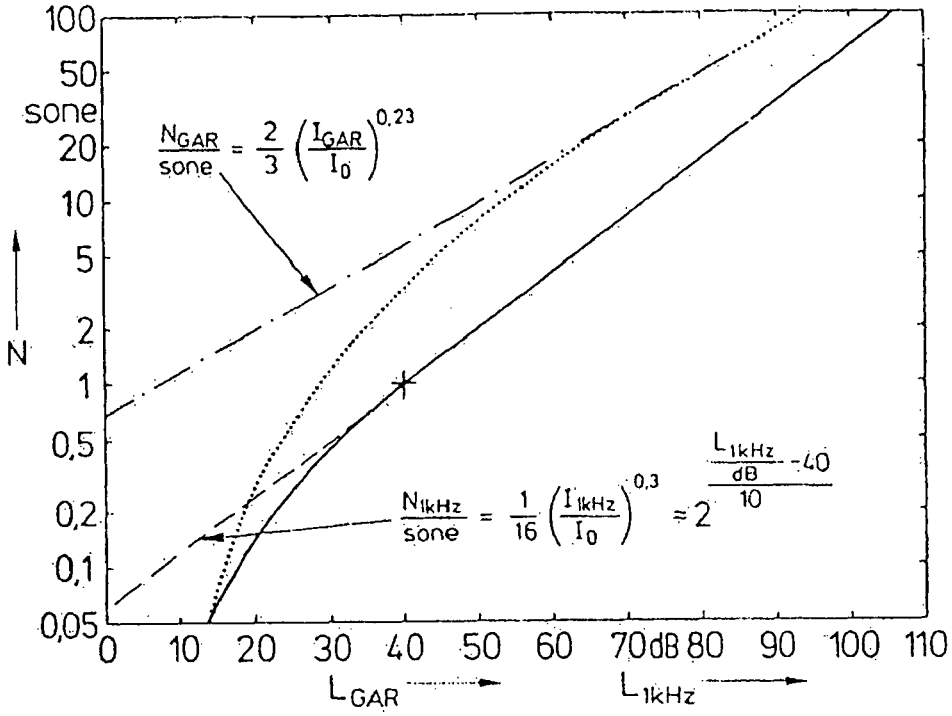
FIG. 2 is a diagram illustrating the loudness as a function of the level of a sinusoidal tone and of a broadband noise signal.

FIG. 2 shows an example of the loudness $N_{1\ kHz}$ of a stationary sinus tone with a frequency of 1 kHz and the loudness $N_{GAR}$ of a stationary uniform excitation noise in relation to the sound level—i.e., for signals for which time effects have no influence on the perceived loudness. Uniform excitation noise (GAR) is defined as a noise that has the same sound intensity in each frequency bandwidth and therefore the same excitation. FIG. 2 shows the loudness in sones in logarithmic scale versus sound pressure levels. For low sound pressure levels—i.e., when approaching the minimum audible threshold, the perceived loudness N of the tone falls dramatically. A relationship exists between loudness N and sound pressure level for high sound pressure levels—this relationship is defined by the equations shown in the figure. "I" refers to the sound intensity of the emitted tone in watts per $m^2$, where $I_0$ refers to the reference sound intensity of $10^{-12}$ watts per $m^2$, which corresponds at center frequencies to roughly the minimum audible threshold (see below). It becomes clear from the continued behavior that the loudness N is a useful mechanism of determining masking by complex noise signals, and is thus a necessary requirement for a model of psychoacoustic masking through spectrally complex, time-dependent sound waves.

If the sound pressure level 1 is measured, which is needed to be able to just about perceive a tone as a function of the frequency, the so-called minimum audible threshold is obtained. Acoustic signals whose sound pressure levels are below the minimum audible threshold cannot be perceived by the human ear, even without the simultaneous presence of a noise signal.

The so-called masked threshold is defined as the threshold of perception for a test sound in the presence of a noisy signal. If the test sound is below this psychoacoustic threshold, the test sound is fully masked. Thus all information within the psychoacoustic range of the masking cannot be perceived—i.e., inaudible information can be added to any audio signal, even noise signals. The area between the masked threshold and minimum audible threshold is the so-called masking area, in which inserted signals cannot be perceived by the human ear. This aspect is utilized by the invention to add additional signal components (in the case shown here, the reference signal z(n) for system identification of the secondary path 106) to the primary signal (in the case shown here, the noise signal x(n)) or to the total signal comprising the noise signal x(n) and, if applicable, music signals, in such a way that the reference signal z(n) can be detected by the receiver (in the case shown here, the error microphone 104) and analyzed for subsequent processing, but is nonetheless inaudible to the human ear.

Numerous investigations have demonstrated that masking effects can be measured for all kinds of human hearing. Unlike many other psychoacoustic impressions, differences between individuals are rare and can be ignored, meaning that a general psychoacoustic model of masking by sound can be produced. The psychoacoustic aspects of the masking are employed in the present invention in order to adapt the reference signal z(n) in real-time to the audio characteristics in such a manner that this acoustically transferred reference signal z(n) is inaudible, regardless of the currently existing noise level, its spectral composition and timing behavior. The noise level can be formed from ambient noise, interference, music or any combination of these.

Here, a distinction is made between two major forms of masking, each of which causes different behavior of the masked thresholds. These are simultaneous masking in the frequency domain and masking in the time domain by timing effects of the masker along the time axis. Moreover, combinations of these two masking types are found in signals such as ambient noise or noise in general.

Simultaneous masking means that a masking sound and useful signal occur at the same time. If the shape, bandwidth, amplitude and/or frequency of the masker changes in such a way that the frequently sinus-shaped test signals are just audible, the masked threshold can be determined for simultaneous masking throughout the entire bandwidth of the audible range—i.e., mainly for frequencies between 20 Hz and 20 kHz. This frequency range generally also represents the available bandwidth of audio equipment used in rear seat entertainment systems in automobiles, and therefore also the useful frequency range for the reference signal z(n) for system identification of the secondary path.

Figure 3:
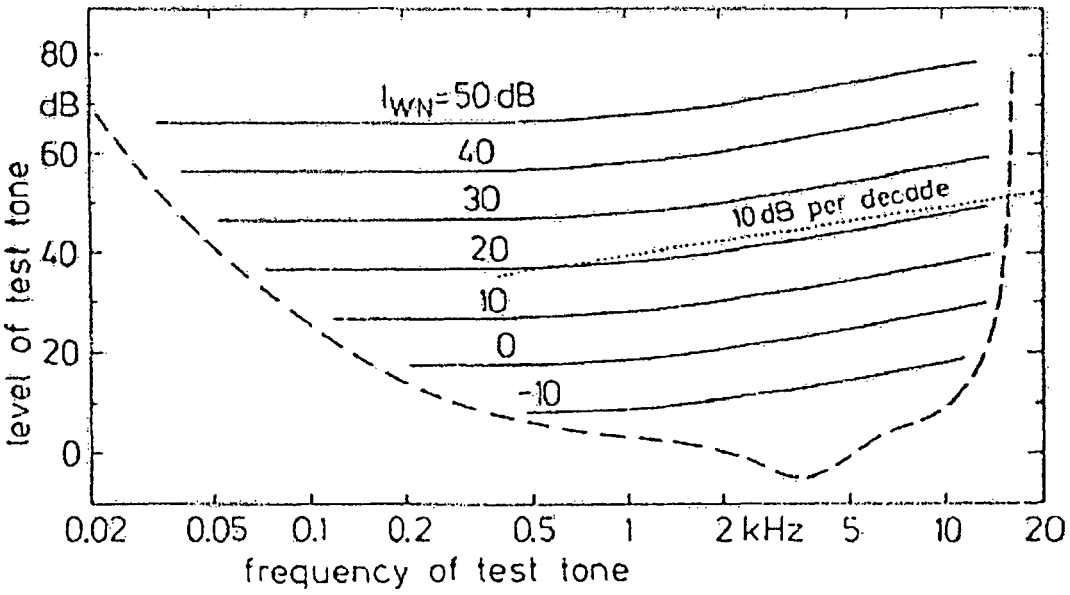
FIG. 3 is a diagram illustrating the masking of a tone by white noise.

FIG. 3 shows the masking of a sinusoidal test tone by white noise. The sound intensity of a test tone just masked by white noise with the sound intensity $I_{WN}$ is displayed in relation to its frequency where the minimum audible threshold is displayed as a dotted line. The minimum audible threshold of a sinus tone for masking by white noise is obtained as follows: below 500 Hz, the minimum audible threshold of the sinus tone is about 17 dB above the sound intensity of the white noise. Above 500 Hz the minimum audible threshold increases with about 10 dB per decade or about 3 dB per octave, corresponding to doubling the frequency. The frequency dependency of the minimum audible threshold is derived from the different critical bandwidth (CB) of the human ear at different center frequencies. Since the sound intensity occurring in a frequency group is compiled in the perceived audio impression, a greater overall intensity is obtained in wider frequency groups at high frequencies for white noise whose level is independent of frequency. The loudness of the sound also rises correspondingly (i.e., the perceived loudness) and causes increased masked thresholds. This means that the purely physical dimensions (such as sound pressure levels of a masker, for example) are inadequate for the modeling of the psychoacoustic effects of masking—i.e., for deriving the masked threshold from dimensions, such as sound pressure level and intensity. Instead, psychoacoustic dimensions such as loudness N are used with the present invention. The spectral distribution and the timing characteristics of masking sounds play a major role, which is evident from the following figures.

If the masked threshold is determined for narrowband maskers, such as sinus tones, narrowband noise or critical bandwidth noise, it is shown that the resulting spectral masked threshold is higher than the minimum audible threshold, even in areas in which the masker itself has no spectral components. Critical bandwidth noise is used in this case as narrowband noise, whose level is designated as $L_{CB}$.

Figure 4:
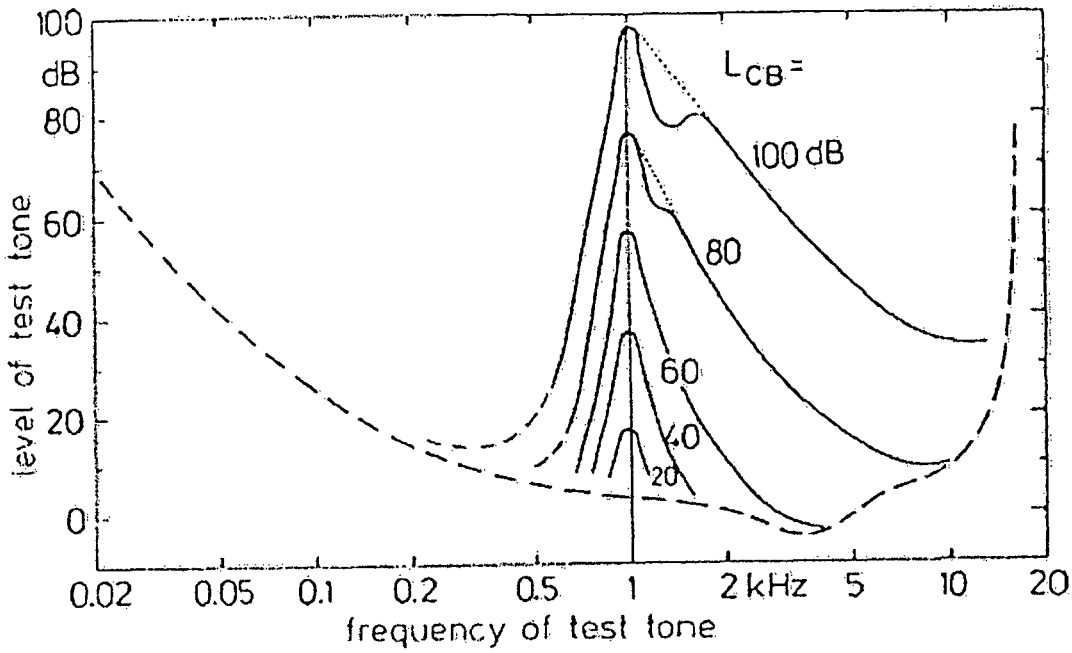
FIG. 4 is a diagram illustrating the masking effect in the frequency domain.

FIG. 4 shows the masked thresholds of sinus tones measured as maskers due to critical bandwidth noise with a center frequency $f_c$ of 1 kHz, as well as of different sound pressure levels in relation to the frequency $f_T$ of the test tone with the level $L_T$. The minimum audible threshold is displayed in FIG. 3 by a dashed line. It can be seen from FIG. 4 that the peak values of the masked thresholds rise by 20 dB if the level of the masker also rises by 20 dB, and that they therefore vary linearly with the level $L_{CB}$ of the masking critical bandwidth noise. The lower edge of the measured masked thresholds—i.e., the masking in the direction of low frequencies lower than the center frequency $f_c$, has a gradient of about −100 dB/octave that is independent of the level $L_{CB}$ of the masked thresholds. This large gradient is only reached on the upper edge of the masked threshold for levels $L_{CB}$ of the masker that are lower than 40 dB. With increases in the level $L_{CB}$ of the masker, the upper edge of the masked threshold becomes flatter and flatter, and the gradient is about −25 dB/octave for an $L_{CB}$ of 100 dB. This means that the masking in the direction of higher frequencies compared to the center frequency $f_c$ of the masker extends far beyond the frequency range in which the masking sound is present. Hearing responds similarly for center frequencies other than 1 kHz for narrowband, critical bandwidth noise. The gradients of the upper and lower edges of the masked thresholds are practically independent of the center frequency of the masker—as seen in FIG. 5.

Figure 5:
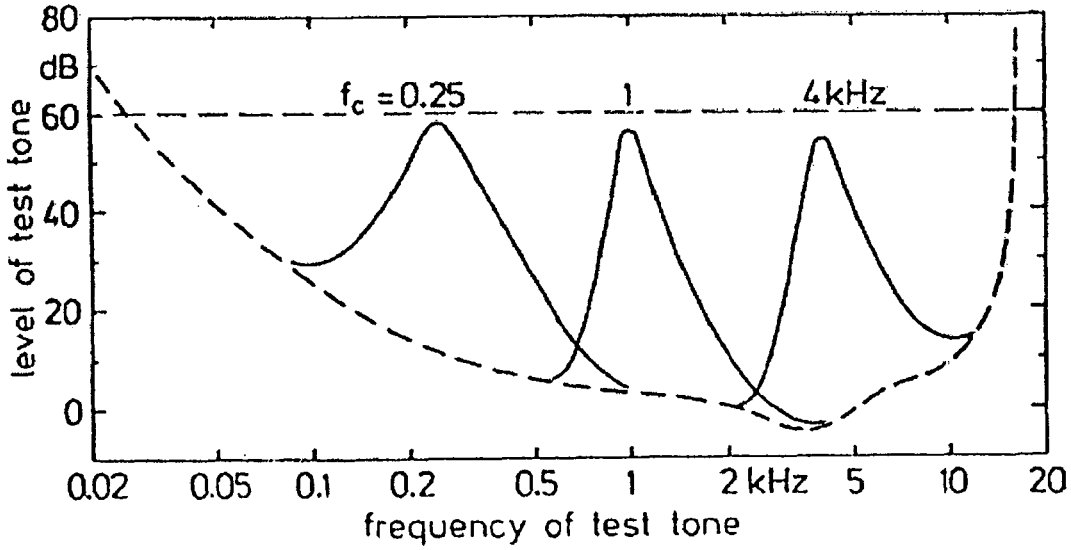
FIG. 5 is a diagram illustrating the masked thresholds for critical frequency narrowband noise in the center frequencies of 250 Hz, 1 kHz and 4 kHz.

FIG. 5 shows the masked thresholds for maskers from critical bandwidth noise in the narrowband with a level $L_{CB}$ of 60 dB and three different center frequencies of 250 Hz, 1 kHz and 4 kHz. The apparently flatter flow of the gradient for the lower edge for the masker with the center frequency of 250 Hz is due to the minimum audible threshold, which applies at this low frequency even at higher levels. Effects such as those shown are likewise included in the implementation of a psychoacoustic model for the masking. The minimum audible threshold is again displayed in FIG. 5 by a dashed line.

Figure 6:
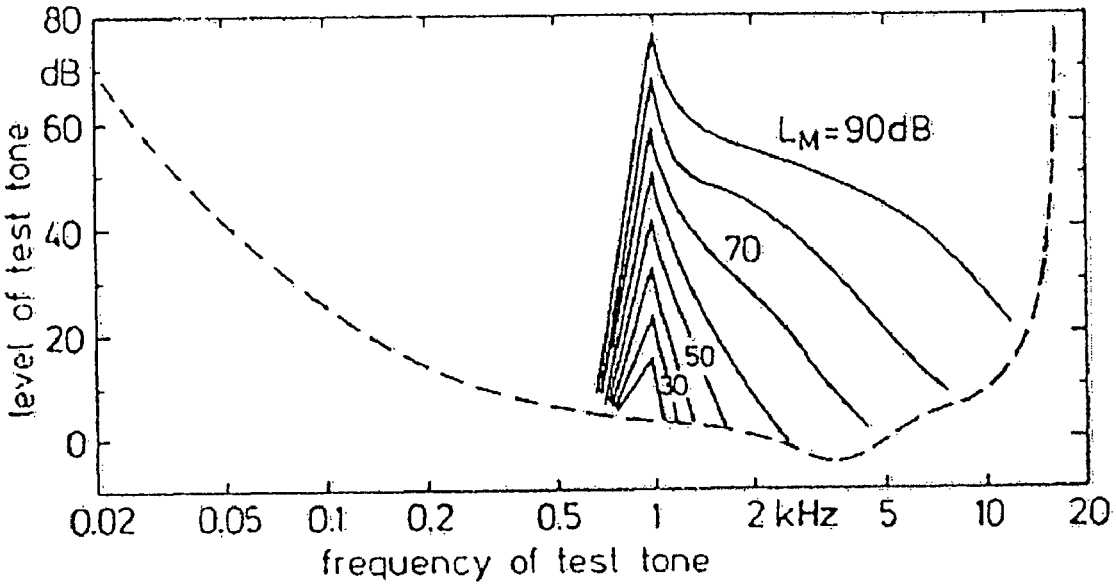
FIG. 6 is a diagram illustrating the masking effect by sinusoidal tones.

If the sinus-shaped test tone is masked by another sinus tone with a frequency of 1 kHz, masked thresholds such as shown in FIG. 6 are obtained in accordance with the frequency of the test tone and the level of the masker $L_M$. As already described earlier, the fanning-out of the upper edge in relation to the level of the masker can be clearly seen, while the lower edge of the masked threshold is practically independent of frequency and level. The upper gradient is measured to be about −100 to −25 dB/octave in relation to the level of the masker, and about −100 dB/octave for the lower gradient. A difference of about 12 dB exists between the level $L_M$ of the masking tone and the maximum values of the masked thresholds $L_r$. This difference is significantly greater than the value obtained with critical bandwidth noise as the masker. This is because the intensities of the two sinus tones of the masker and of the test tone are added together at the same frequency, unlike the use of noise and a sinus tone as the test tone. Consequently, the tone is perceived much earlier—i.e., for low levels for the test tone. Moreover, when emitting two sinus tones at the same time, other effects (e.g., beats) arise, which likewise lead to increased perception or reduced masking.

Figure 7:
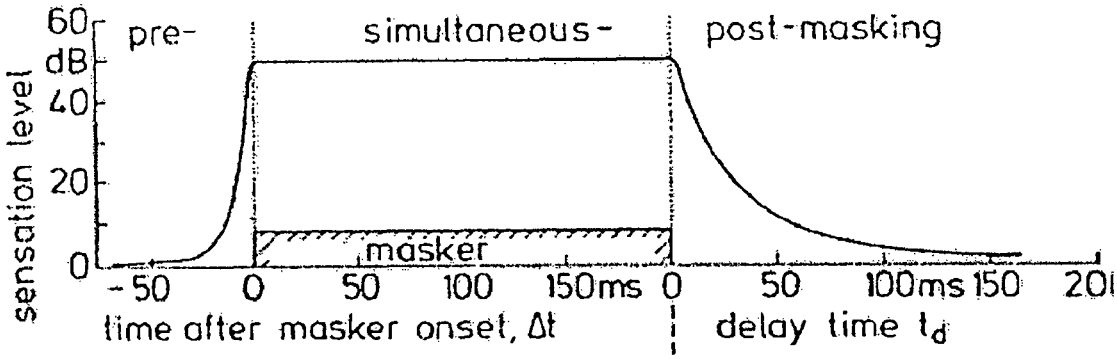
FIG. 7 is a diagram illustrating simultaneous, pre- and post-masking.

Along with the described simultaneous masking, another psychoacoustic effect of masking is the so-called time masking. Two different kinds of time masking are distinguished: pre-masking refers to the situation in which masking effects occur already before the abrupt rise in the level of a masker. Post-masking describes the effect that occurs when the masked threshold does not immediately drop to the minimum audible threshold in the period after the fast fall in the level of a masker. FIG. 7 schematically shows both the pre- and post-masking, which are explained in greater detail further below in connection with the masking effect of tone impulses.

To determine the effects of the time pre- and post-masking, test tone impulses of a short duration must be used to obtain the corresponding time resolution of the masking effects. Here the minimum audible threshold and masked threshold are both dependent on the duration of a test tone. Two different effects are known in this regard. These refer to the dependency of the loudness impression on the duration of a test impulse (see FIG. 8) and the relationship between the repetition rate of short tone impulses and loudness impression (see FIG. 9).

The sound pressure level of a 20-ms impulse has to be increased by 10 dB in comparison to the sound pressure level of a 200-ms impulse in order to obtain the identical loudness impression. Upward of an impulse duration of 200 ms, the loudness of a tone impulse is independent of its duration. It is known for the human ear that processes with a duration of more than about 200 ms represent stationary processes. Psychoacoustically certifiable effects of the timing properties of sounds exist if the sounds are shorter than about 200 ms.

Figure 8:
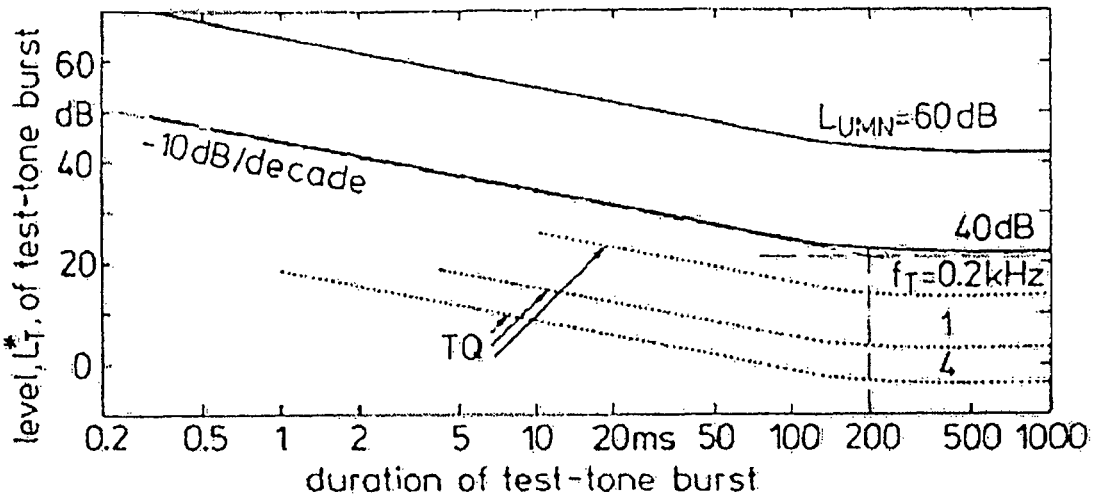
FIG. 8 is a diagram illustrating the relationship of the loudness perception and the duration of a test tone pulse.

FIG. 8 shows the dependency of the perception of a test tone impulse on its duration. The dotted lines denote the minimum audible thresholds TQ of test tone impulses for the frequencies $f_T$=200 Hz, 1 kHz and 4 kHz in relation to their duration, whereby the minimum audible thresholds rise with about 10 dB per decade for durations of the test tone of less than 200 ms. This behavior is independent of the frequency of the test tone, the absolute location of the lines for different frequencies $f_T$ of the test tone reflects the different minimum audible thresholds at these different frequencies.

The continuous lines represent the masked thresholds for masking a test tone by uniform masking noise (UMN) with a level $L_{UMN}$ of 40 dB and 60 dB . Uniform masking noise is defined to be such that it has a constant masked threshold throughout the entire audible range—i.e., for all frequency groups from 0 to 24 barks. In other words, the displayed characteristics of the masked thresholds are independent of the frequency $f_T$ of the test tone. Just like the minimum audible thresholds TQ, the masked thresholds also rise with about 10 dB per decade for durations of the test tone of less than 200 ms.

Figure 9:
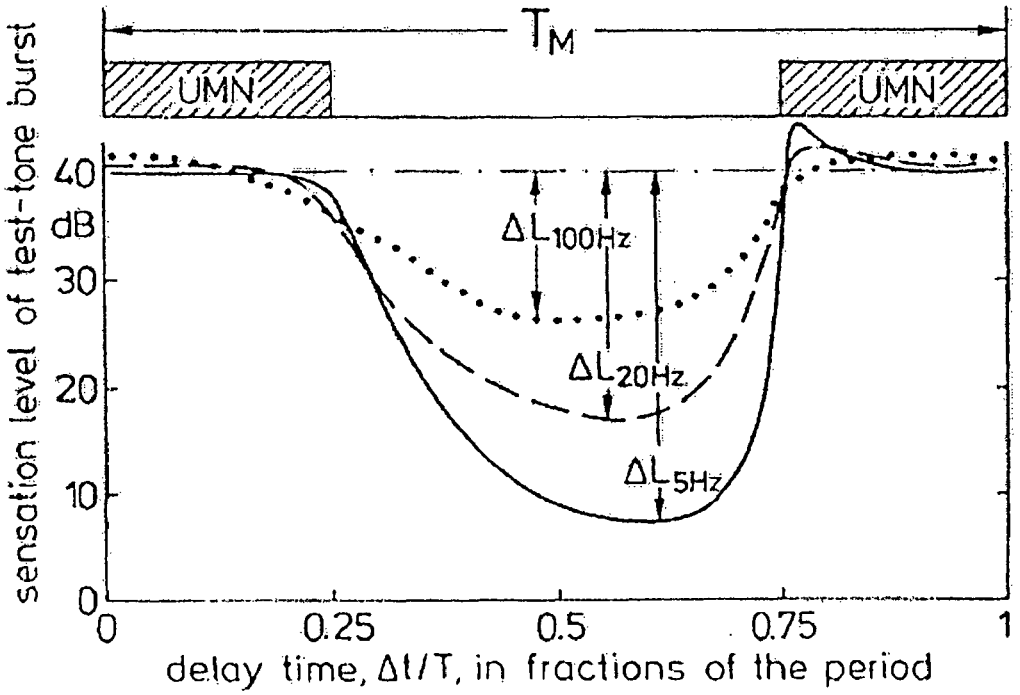
FIG. 9 is a diagram illustrating the relationship of the masked threshold and the repetition rate of a test tone pulse.

FIG. 9 shows the dependency of the masked threshold on the repetition rate of a test tone impulse with the frequency 3 kHz and a duration of 3 ms. Uniform masking noise is again the masker: it is modulated with a rectangular shape—i.e., it is switched on and off periodically. The examined modulation frequencies of the uniform masking noise are 5 Hz, 20 Hz and 100 Hz. The test tone is emitted with a subsequent frequency identical to the modulation frequency of the uniform masking noise. During the trial, the timing of the test tone impulses is correspondingly varied in order to obtain the time-related masked thresholds of the modulated noise.

FIG. 9 shows the shift in time of the test tone impulse along the abscissa standardized to the period duration $T_M$ of the masker. The ordinate shows the level of the test tone impulse at the calculated masked threshold. The dashed line represents the masked threshold of the test tone impulse for an unmodulated masker (i.e., continuously present masker with otherwise identical properties) as reference points.

The flatter gradient of the post-masking in FIG. 9 in comparison to the gradient of the pre-masking is clear to see. After activating the rectangular-shaped modulated masker, the masked threshold is exceeded for a short period. This effect is known as an overshoot. The maximum drop ΔL in the level of the masked threshold for modulated uniform masking noise in the pauses of the masker is reduced as expected in comparison to the masked threshold for stationary uniform masking noise in response to an increase in the modulation frequency of the uniform masking noise—in other words, the masked threshold of the test tone impulse can fall less and less during its lifetime to the minimum value specified by the minimum audible threshold.

FIG. 9 also illustrates that a masker already masks the test tone impulse before the masker is switched on at all. This effect is known—as already mentioned earlier—as pre-masking, and is based on the fact that loud tones and noises (i.e., with a high sound pressure level) can be processed more quickly by the hearing sense than quiet tones. The pre-masking effect is considerably less dominant than that of post-masking, and is therefore often omitted in the use of psychoacoustic models to simplify the corresponding algorithms. After disconnecting the masker, the audible threshold does not fall immediately to the minimum audible threshold, but rather reaches it after a period of about 200 ms. The effect can be explained by the slow settling of the transient wave on the basilar membrane of the inner ear.

On top of this, the bandwidth of a masker also has direct influence on the duration of the post-masking. The particular components of a masker associated with each individual frequency group cause post-masking as shown in FIGS. 10 and 11.

Figure 10:
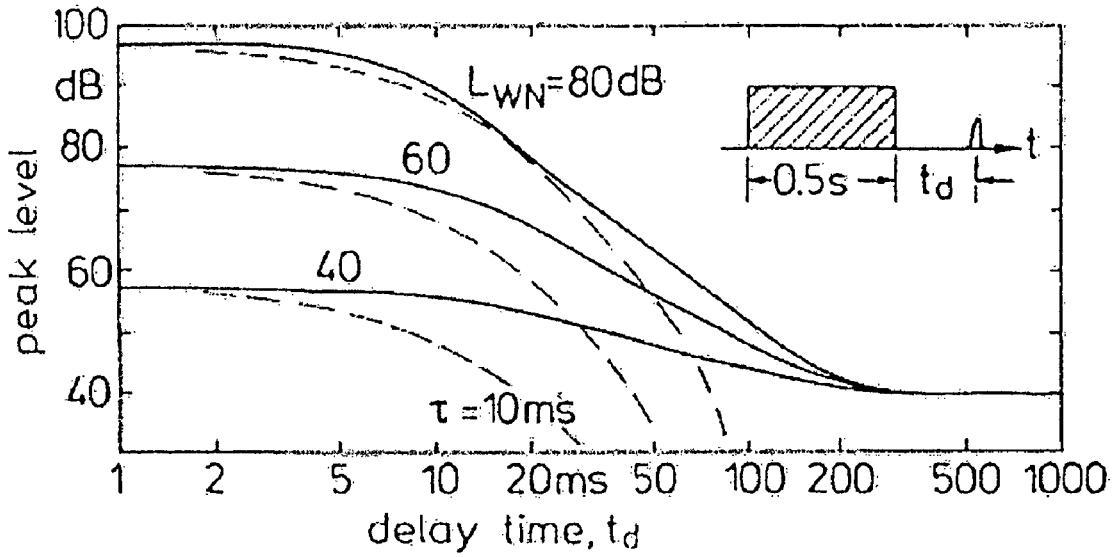
FIG. 10 is a diagram illustrating the post-masking effect in general.
Figure 11:
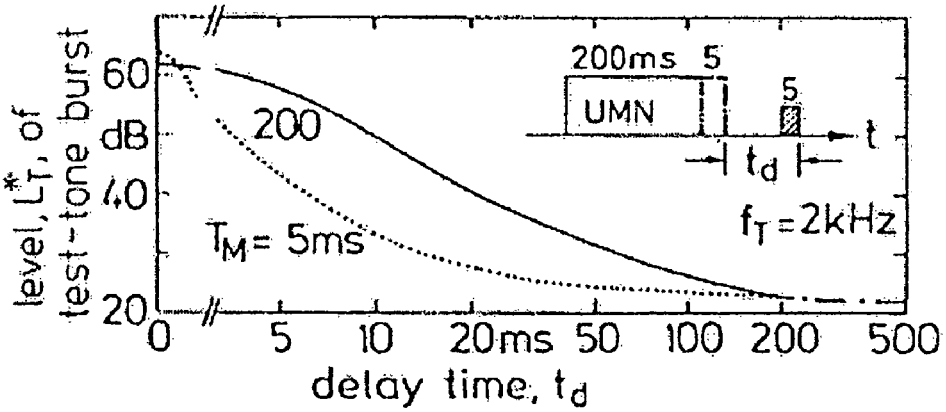
FIG. 11 is a diagram illustrating the post-masking effect in relation to the duration of the masker.

FIG. 10 shows the level characteristics $L_T$ of the masked threshold of a Gaussian impulse with a duration of 20 μs as the test tone that is present at a time $t_v$ after the end of a rectangular-shaped masker consisting of white noise with a duration of 500 ms, where the sound pressure level $L_{WR}$ of the white noise takes on the three levels 40 dB, 60 dB and 80 dB. The post-masking of the masker comprising white noise can be measured without spectral effects, since the Gaussian-shaped test tone with a short duration of 20 μs in relation to the perceivable frequency range of the human ear also demonstrates a broadband spectral distribution similar to that of the white noise. The continuous curves in FIG. 10 illustrate the characteristic of the post-processing determined by measurements. They in turn reach the value for the minimum audible threshold of the test tone (about 40 dB for the short test tone used in this case) after about 200 ms, independently of the level $L_{WR}$ of the masker. FIG. 10 shows curves using dotted lines that correspond to an exponential falling away of the post-masking with a time constant of 10 ms. It can be seen that a simple approximation of this kind can only hold true for large levels of the masker, and that it never reflects the characteristic of the post-masking in the vicinity of the minimum audible threshold.

There is also a relationship between the post-masking and the duration of the masker. The dotted line in FIG. 11 shows the masked threshold of a Gaussian-shaped test tone impulse with a duration of 5 ms and a frequency of $f_T$=2 kHz as a function of the delay time $t_d$ after the deactivation of a rectangular-shaped modulated masker comprising uniform masking noise with a level $L_{UMN}$=60 dB and a duration $T_M$=5 ms. The continuous line shows the masked threshold for a masker with a duration of $T_M$=200 ms with parameters that are otherwise identical for test tone impulse and uniform masking noise.

The measured post-masking for the masker with the duration $T_M$=200 ms matches the post-masking also found for all maskers with a duration $T_M$ longer than 200 ms but with parameters that are otherwise identical. In the case of maskers of shorter duration, but with parameters that are otherwise identical (like spectral composition and level), the effect of post-masking is reduced, as is clear from the characteristics of the masked threshold for a duration $T_M$=5 ms of the masker. To use the psychoacoustic masking effects in algorithms and methods, such as the psychoacoustic masking model, it is also taken into consideration what resulting masking is obtained for grouped, complex or superimposed individual maskers. Simultaneous masking exists if different maskers occur at the same time. Only few real sounds are comparable to a pure sound, such as a sinus tone. In general, the tones emitted by musical instruments, as well as the sound arising from rotating bodies, such as engines in automobiles, have a large number of harmonics. Depending on the composition of the levels of the partial tones, the resulting masked thresholds can vary greatly.

Figure 12:
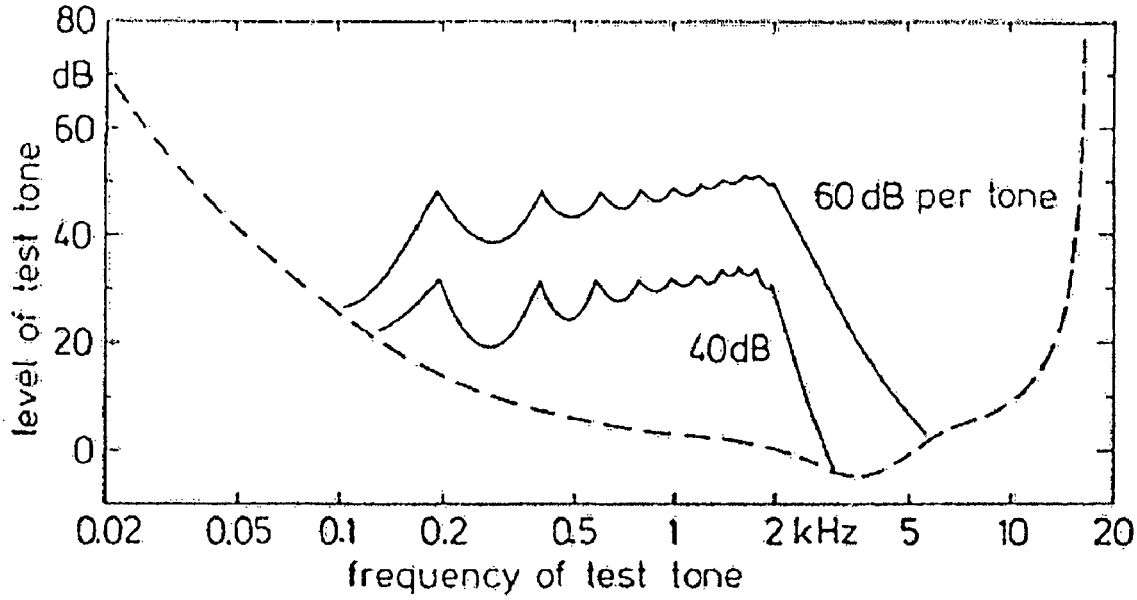
FIG. 12 is a diagram illustrating the simultaneous masking by a complex tone.

FIG. 12 shows the simultaneous masking for a complex sound. The masked threshold for the simultaneous masking of a sinus-shaped test tone is represented by the 10 harmonics of a 200-Hz sinus tone in relation to the frequency and level of the excitation. All harmonics have the same sound pressure level, but their phase positions are statistically distributed. FIG. 12 shows the resulting masked thresholds for two cases in which all levels of the partial tones are either 40 dB or 60 dB. The fundamental tone and the first four harmonics are each located in separate frequency groups. This means that there is no additive superimposition of the masking parts of these complex sound components for the maximum value of the masked threshold.

However, the overlapping of the upper and lower edges and the depression resulting from the addition of the masking effects—which at its deepest point is still considerably higher than the minimum audible threshold—can be clearly seen. In contrast, most of the upper harmonics are within a critical bandwidth of the human hearing. A strong additive superimposition of the individual masked thresholds takes place in this critical bandwidth. As a consequence of this, the addition of simultaneous maskers cannot be calculated by adding their intensities together, but instead the individual specific loudness values must be added together to define the psychoacoustic model of the masking.

To obtain the excitation distribution from the audio signal spectrum of time-varying signals, the known characteristics of the masked thresholds of sinus tones for masking by narrowband noise are used as the basis of the analysis. A distinction is made here between the core excitation (within a critical bandwidth) and edge excitation (outside a critical bandwidth). An example of this is the psychoacoustic core excitation of a sinus tone or a narrowband noise with a bandwidth smaller than the critical bandwidth matching the physical sound intensity. Otherwise, the signals are correspondingly distributed between the critical bandwidths masked by the audio spectrum. In this way, the distribution of the psychoacoustic excitation is obtained from the physical intensity spectrum of the received time-variable sound. The distribution of the psychoacoustic excitation is referred to as the specific loudness. The resulting overall loudness in the case of complex audio signals is found to be an integral over the specific loudness of all psychoacoustic excitations in the audible range along the tonal scale—i.e., in the range from 0 to 24 barks, and also exhibits corresponding time relations. Based on this overall loudness, the masked threshold is then created on the basis of the known relationship between loudness and masking, whereby the masked threshold drops to the minimum audible threshold in about 200 ms under consideration of time effects after termination of the sound within the relevant critical bandwidth (see also FIG. 10, post-masking).

In this way, the psychoacoustic masking model is implemented under consideration of all masking effects discussed above. It can be seen from the preceding figures and explanations what masking effects are caused by sound pressure levels, spectral compositions and timing characteristics of noises, such as background noise, and how these effects can be utilized to manipulate a desired test signal adaptively and in real time for system identification of the secondary path in such a way that it cannot be perceived by the listener in an environment of the kind described.

Figure 13A:
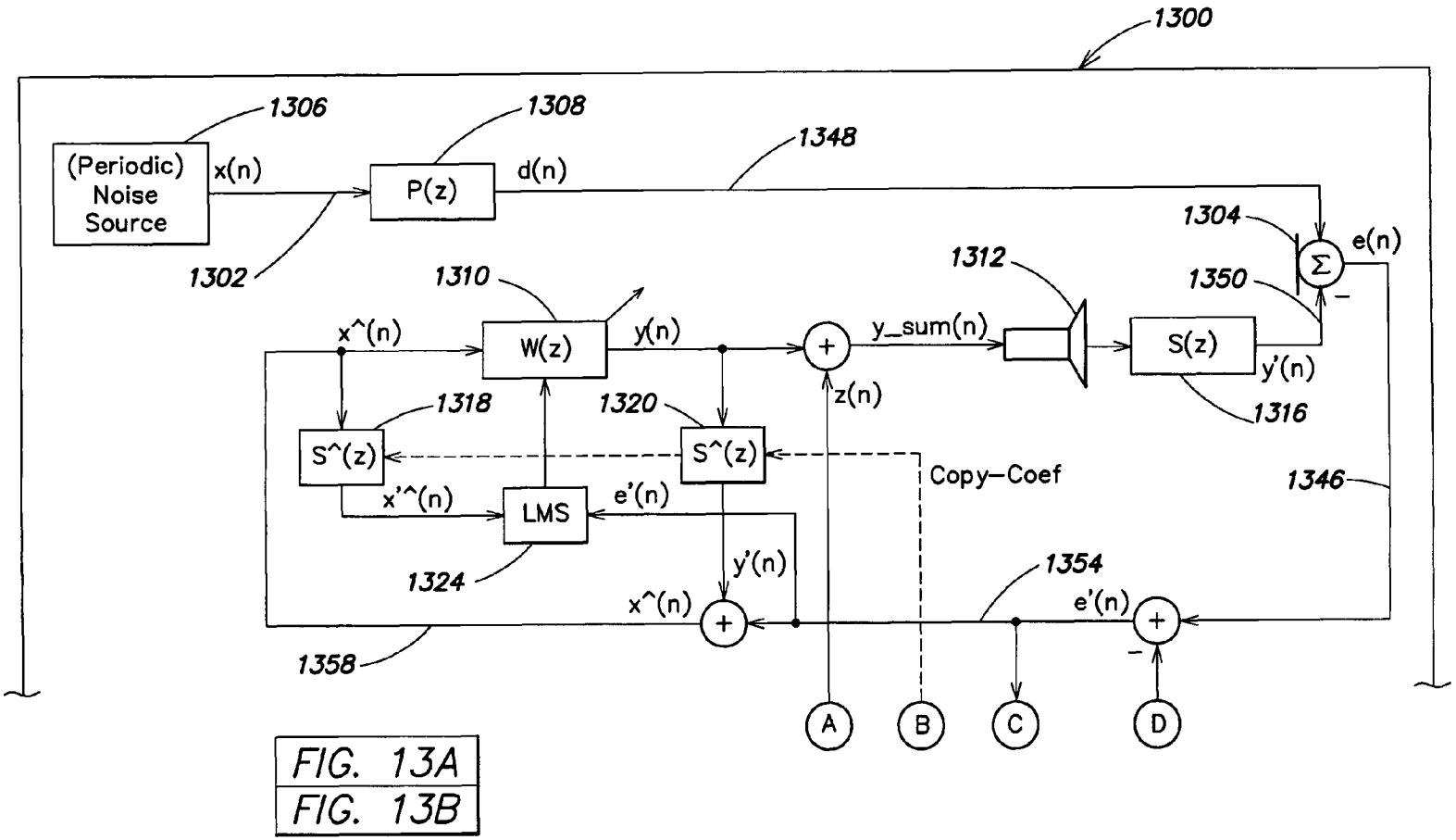
FIG. 13 is a block diagram showing a system for psychoacoustic system identification.
Figure 13B:
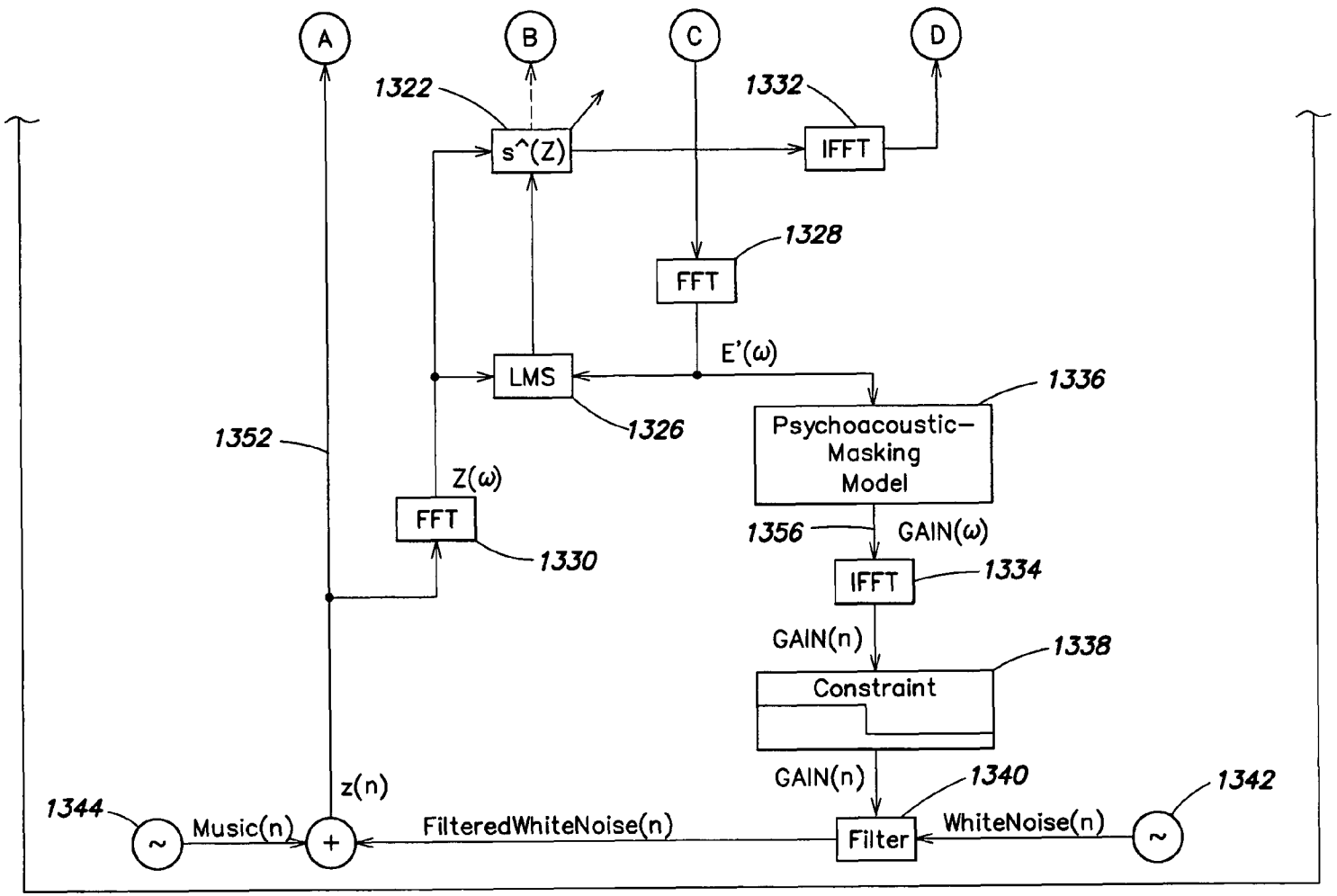
Figures 14A, 14B:
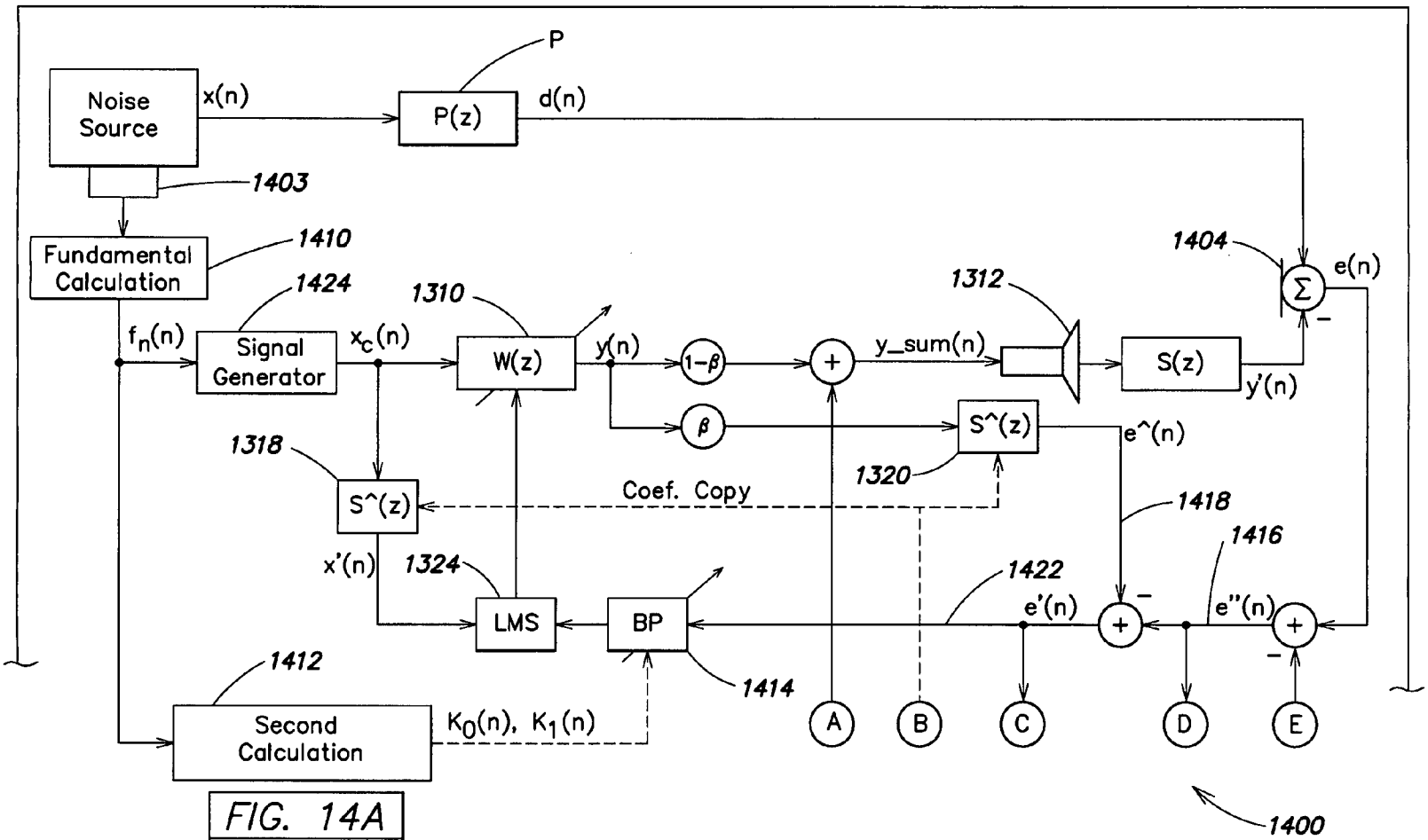
FIG. 14 is a block diagram showing another system for psychoacoustic system identification.
Figure 14B:
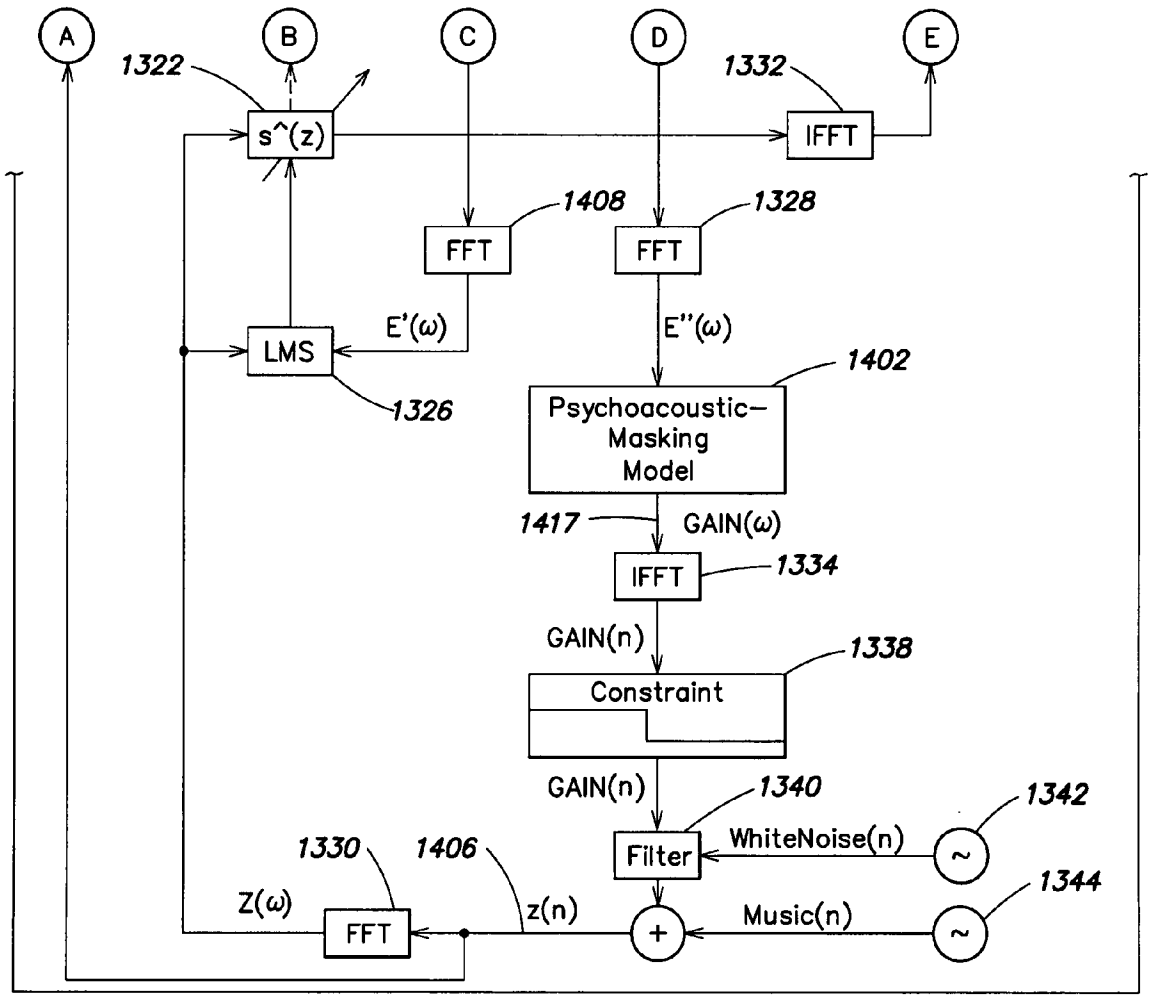
Figures 15A, 15B:
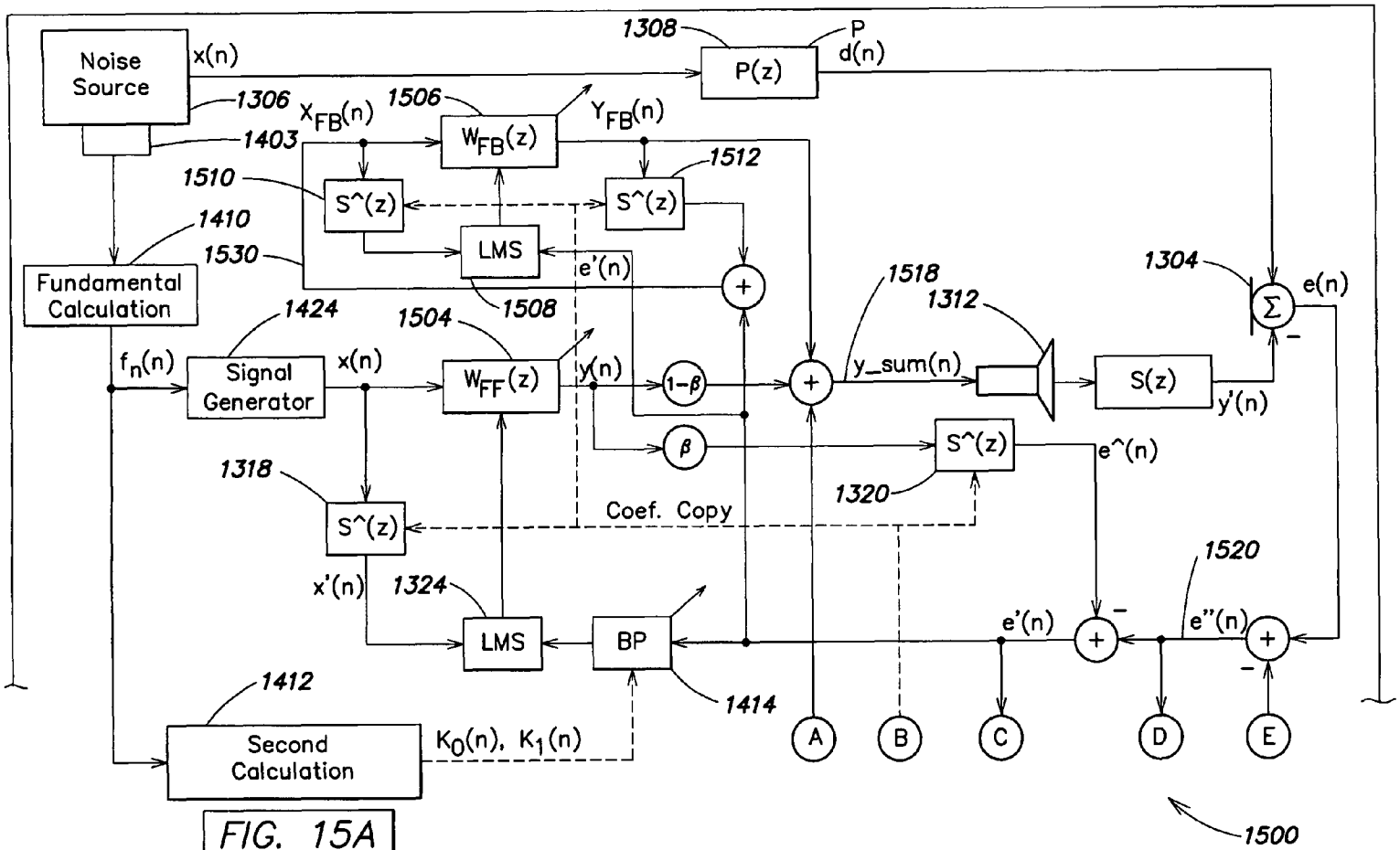
FIG. 15 is a block diagram showing yet another system for psychoacoustic system identification.
Figure 15B:
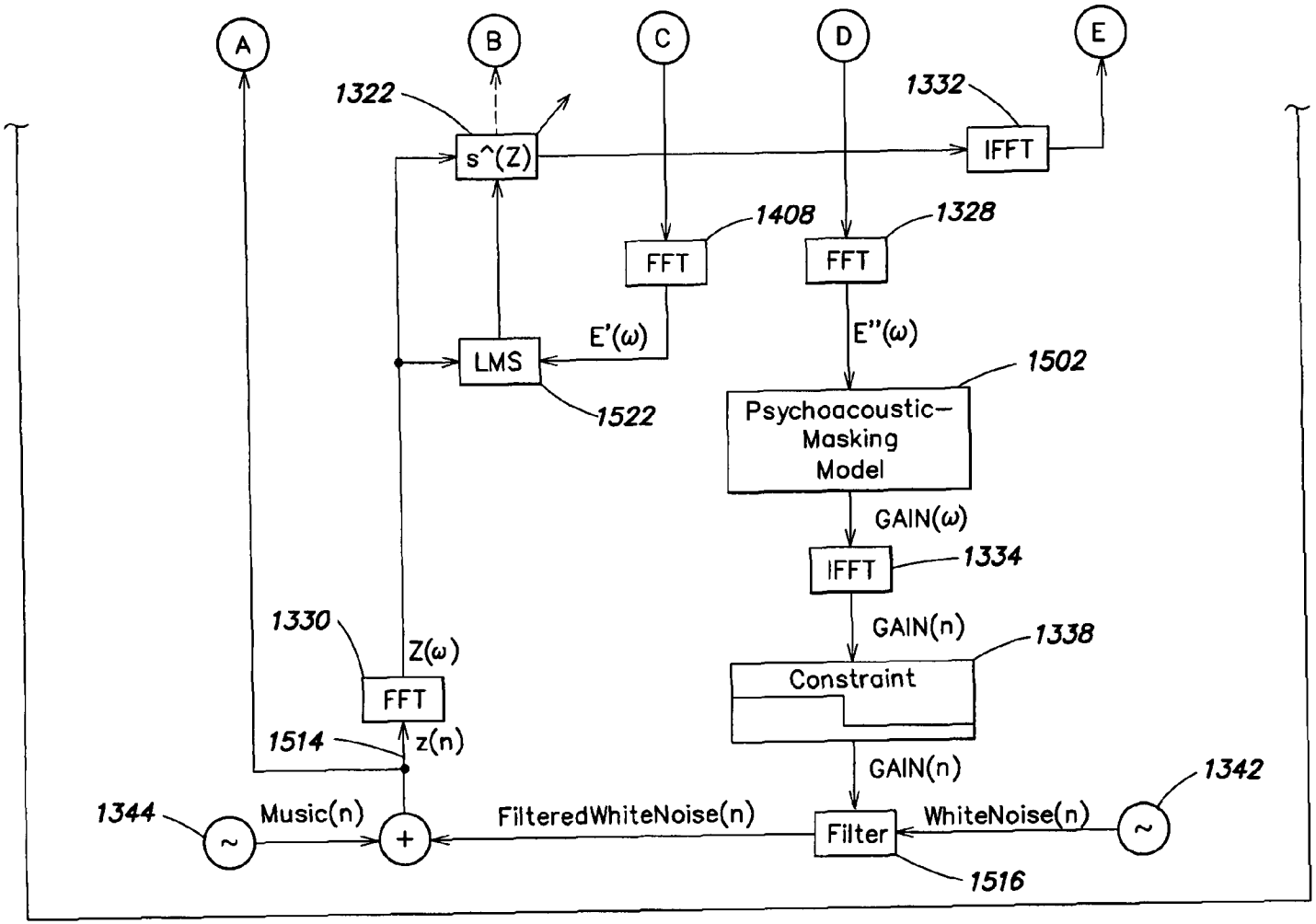

FIGS. 13 to 15 below illustrate three examples for application of the psychoacoustic masking model with the present invention, particularly for psychoacoustic system identification of the secondary path. FIG. 13 illustrates a system 1300 in accordance with the invention for employment of the psychoacoustic masking model (PMM) for use in an ANC system for noise control in combination with headphones. No suitable reference signal correlated with the expected noise signal is available to this application, and therefore a feedback ANC system as described earlier is used. A feedforward ANC system requires the presence of a reference signal x(n) on a line 1302 correlated with the expected noise signal, and that the causality condition is satisfied in such a way that the sensor for reception of this reference signal is always closer to the source of the noise signal on the line 1302 to reduce than the error microphone 1304 (see FIG. 1). This causality condition cannot be satisfied, particularly for headphones with freedom of movement in an unknown room.

An example of a system according to the invention as shown in FIG. 13 comprises a source 1306 generating the noise signal (e.-g., a periodic noise signal) on the line 1302, the error microphone 1304 and a primary path 1308 having a transfer function P(z) for sonic transmission from the noise source 1306 to the error microphone 1304. The system of FIG. 13 also comprises an adaptive filter 1310 having a transfer function W(z), a loudspeaker 1312 connected downstream of the adaptive filter 1310 for generating the cancellation soundwaves, and a secondary path 1316 having a transfer function S(z) for sonic transmission from the loudspeaker 1312 to the error microphone 1304.

The system of FIG. 13 also comprises a first filter 1318 with a transfer function Ŝ(z), a second filter 1320 with the transfer function Ŝ(z) and a third filter 1322 with the transfer function Ŝ(z), which were estimated from S(z) using the system identification method as described by S. Mitra, J. S. Kaiser, Handbook For Digital Signal Processing, Wiley and Sons 1993, pages 1085-1092 as well as a first control block 1324 for adaptation of the filter coefficients of the adaptive filter 1310 using the Least Mean Square algorithm, and a second control block 1326 for adaptation of the filter coefficients of the first, second and third filters 1318, 1320 and 1322, respectively, using the Least Mean Square algorithm. The identical transfer functions Ŝ(z) of the first and second 1318 and 1320 are obtained in each case by simply copying the filter coefficients of the third filter 1322 determined during the adaptive system identification of the secondary path S carried out in real-time.

The system of FIG. 13 also comprises a first FFT unit 1328 and a second FFT unit 1330 for Fast Fourier Transformations of signals from the time domain to the frequency domain, as well as a first 1332 and a second IFFT 1334 for Inverse Fast Fourier Transformations of signals from the frequency domain to the time domain. Further, a Psychoacoustic Masking Model unit 1336, a constraint unit 1338 to avoid circular convolution products, a filter 1340 and a source of white noise 1342, and a music signal source 1344.

An error signal e(n) on line 1346 at the error microphone 1304 is composed, on one hand, of a signal d(n) on line 1348 resulting from a noise signal x(n) from the noise source 1306 transmitted over the primary path 1308 having the transfer function P(z), and, on the other hand, of a signal y'(n) on line 1350, resulting from a canceling signal y_sum(n) supplied to the loudspeaker 1312 and then transmitted to the error microphone 1304 over the secondary path 1316 having the transfer function S(z). A reference signal z(n) on line 1352 is obtained by adding a signal Music(n) from a music source 1344 to a signal FilteredWhiteNoise(n) provided by the white-noise source 1342 via filter 1340. The reference signal z(n) on the line 1352 is added to an output signal y(n) of the adaptive filter 1310, the sum of both the signals forming the signal y_sum(n) applied to the loudspeaker 1312.

The reference signal z(n) on the line 1352 is also supplied to the Fast Fourier Transformation unit 1330 to be transformed into a frequency domain signal Z(ω), which after filtering through the adaptive filter 1322 with the transfer function Ŝ(z) and subsequent Inverse Fast Fourier Transformation through the unit 1332 is subtracted from the error signal e(n) on the line 1346 to yield the signal e'(n) on line 1354. The first FFT unit 1328 converts the signal e'(n) on the line 1354 to a signal E'(ω), which is supplied together with the signal Z(ω) to a second LMS unit 1326 for adaptive control of the first, second and third filter coefficients of the filters 1318, 1320 and 1322, respectively, the filters using the Least Mean Square algorithm. The signal E'(ω) is also used as an input signal for the Psychoacoustic Masking Model unit 1336, which under consideration of the current masking through the noise at the site of the error microphone (i.e., the site of the headphones) generates a signal GAIN(ω) on line 1356, which is used to determine the reference signal z(n). To do so, signal GAIN(ω) is converted by the IFFT 1334 to a time domain signal Gain(n) and set by the constraint unit 1338 for avoiding circular convolution products, where the coefficients of the filter 1340 are controlled by the signal Gain(n) which corresponds to the new filter coefficient set. The FilteredWhiteNoise(n) signal matches the inaudible reference signal for system identification of the secondary path P (inaudible because the reference signal is set below the audible threshold of the current noise signal).

The reference signal z(n) on the line 1352 may also include the useful signal Music(n) which, however, is not essential for the function of the present system. The signal e'(n) on the line 1354 is added to the signal y'(n) derived from the signal y(n) through the transfer function S(z) of the second filter 1320 in order to obtain a signal x̂(n) on line 1358. The signal x̂(n) on the line 1358 represents the input signal for the adaptive filter 1310 and is also used after processing by the first filter 1318 as signal x'̂(n) supplied, as well as a signal e'(n), to the first unit 1324 using the Least Mean Square algorithm for adaptive control of the filter coefficients of the filter 1310.

FIG. 14 shows an ANC/MST system 1400 with noise control in the interior of an automobile using a Psychoacoustic Masking Model unit 1402. In contrast to the headphones application shown in FIG. 13, this application has a reference signal $f_n(n)$ correlated with the expected noise signal where a feedforward ANC/MST system is employed. The reference signal $f_n(n)$ is generated through a non-acoustic sensor 1403, for example, by a piezoelectric transducer, or electro-acoustic transducer, a Hall element a rpm meter, arranged at the noise source site. Since the circuit shown in FIG. 14 is used in an environment whose spatial characteristics (e.g., the interior of an automobile) are known, the causality condition required for a feedforward system, according to which the sensor for the reference signal $f_n(n)$ always has to be closer to the source of the noise signal to be reduced than the error microphone 1404, can be reliably satisfied by suitable positioning of these components.

In the system of FIG. 14, the error signal e(n) at the error microphone 1404 is, like in the system of FIG. 13, composed of the signals d(n) and y_sum(n). Reference signal z(n) on line 1406 is composed of the signal Music(n) from music source 1344 and a filtered version of the signal WhiteNoise(n) from the filter 1340. The reference signal z(n) on the line 1406 is added to the output signal y(n) of the adaptive filter 1310 weighted with 1−β yields the signal y_sum(n). The signal z(n) is again fed via the second FFT unit 1330 to obtain the frequency domain signal Z(ω), which after filtering through the third adaptive filter 1322 and subsequent Inverse Fast Fourier Transformation through the IFFT unit 1332 is subtracted from the error signal e(n) to yield the signal e''(n) on line 1416 in comparison to FIG. 13. The signal e''(n) is converted to the signal E''(ω) by the Fast Fourier Transformation unit $FFT_1$. The signal E''(ω) is used as an input signal for the Psychoacoustic Masking Model unit 1402, which under consideration of the current masking through the noise at the site of the error microphone generates the signal GAIN(ω) on line 1417 which is used to determine the reference signal z(n) on the line 1406. To do so, signal GAIN(ω) in the frequency domain is transformed by the Inverse Fast Fourier Transformation unit 1334 to the signal Gain(n) in the time domain and constraint by the constraint unit 1338 in such a way that the signal WhiteNoise(n) generated from the source 1342 is converted to the signal FilteredWhiteNoise(n) using the filter 1340, to which the new filter coefficient set Gain(n) is loaded. The FilteredWhiteNoise(n) signal matches the inaudible reference signal for system identification of the secondary path P (inaudible because the signal is below the audible threshold of the current noise signal). Moreover, the reference signal z(n) may also include the useful signal Music(n), which is not essential for the function of the present system. The signal e^(n) on line 1418 is subtracted from the signal e"“(n) on the line 1416, where the signal on the line 1418 is output by the filter 1320 supplied with β·y(n) at its input. The resultant signal e'(n) on line 1422 is transformed by the Fast Fourier Transformation unit 1408 to the signal E"(ω), and is used together with Z(ω) from the second FFT unit 1330 in the LMS unit 1326 for adaptive control of the filter coefficients of the first, second and third filters 1318, 1320 and 1322.

The non-acoustic sensor 1403 generates an electrical signal correlated with the acoustic noise signal x(n); the electrical signal is supplied to the calculation circuit 1410 from which the signal $f_n$ (n)is obtained. Signal generator 1424 then generates an input signal $x_c$(n) for the filter 1310 corresponding to the noise signal where $x_c$(n)~x(n). The second calculation unit 1412 determines the filter coefficients K(n) for the adaptive bandpass filter 1414. Using the first filter 1318 with the transfer function S^(z), the signal $x_c$(n) is converted to the signal x'(n) and is then used together with the signal e'(n) filtered through the bandpass filter 1414 for control of the first LMS circuit 1324 for adaptive control of the filter coefficients of the filter 1310 using the Least Mean Square algorithm.

The system of FIG. 15 is an ANC/MST system 1500 for noise control in the interior of an automobile using a Psychoacoustic Masking Model unit 1502. In addition to the feedforward system shown in FIG. 14, the system of FIG. 15 also includes a feedback system to produce a hybrid ANC/MST system, which combines the specific advantages of both feedforward and feedback systems. In particular, the feedback path can successfully reduce the noise signals in the interior of an automobile that diffusely and randomly intrude from outside and that do not correlate with the reference signal x(n) determined at a previously known noise source.

The adaptive filter 1310 with the transfer function W(z) from FIG. 14 is replaced in the system of FIG. 15 by an equivalent filter 1504 with a transfer function $W_{FF}$(Z), and which is part of the feedforward system that is equivalent to the system shown of FIG. 14. In addition, the system of FIG. 15 includes a second filter 1506 with a transfer function $W_{FB}$(Z) for the feedback path and a third LMS unit 1508 for adaptive control of the filter coefficients of the second adaptive filter 1506 using the Least Mean Square algorithm. The system of FIG. 15 further includes a fourth filter 1510 with a transfer function S^(z) and a fifth filter 1512 with a transfer function S^(z), which are estimated using the method of system identification from the transfer function S(z) of the secondary path S.

As in the system of FIG. 14, the error signal e(n) at the error microphone is composed of the signal x(n) generated by the noise source 1306 and filtered on the primary path 1308 with the transfer function P(z) from the noise x(n) and the signal y'(n), which is the canceling signal y_sum(n) filtered by the transfer functions of the loudspeaker 1312 and the secondary path S. Reference signal z(n) on line 1514 is derived from the sum of the signal Music(n) from the music source 1344 and the signal FilteredWhiteNoise(n) from the white noise source 1342 evaluated with the Psychoacoustic Masking Model by filter 1516. The reference signal z(n) on the line 1514 is added to the output signal y(n) of the first adaptive filter 1504 weighted with 1-β as well as to the output signal $y_{FB}$(n) of the second adaptive filter 1506 with the transfer function $W_{FB}$(Z) yields the signal y_sum(n) on line 1518.

The signal z(n) is also transformed via the Fast Fourier Transformation unit 1330 into the signal Z(ω), which after filtering through the third adaptive filter 1322 with the transfer function S^(z) and subsequent Inverse Fast Fourier Transformation through the unit 1332 is subtracted from the error signal e(n) to yield the signal e"(n) on line 1520 in comparison to the system of FIG. 13. The signal e"(n) in the time domain is converted to the signal E"(ω) in the frequency domain by the Fast Fourier Transformation unit 1328. The signal E"(ω) is used as an input signal for the Psychoacoustic Masking Model unit 1502, which under consideration of the current masking through the noise at the site of the error microphone 1304 generates the signal GAIN(ω), which is used to determine the reference signal z(n) through the filter 1516. To do so, the GAIN(ω) is converted by the second Inverse Fast Fourier Transformation unit 1334 to the time signal Gain(n) and constraint by the constraint unit 1338 in such a way that the signal WhiteNoise(n) generated from the source 1342 is converted to the signal FilteredWhiteNoise(n) using the filter 1516, to which the new filter coefficient set Gain(n) is loaded.

The FilteredWhiteNoise(n) signal matches the inaudible reference signal for system identification of the secondary path P (inaudible because the signal is below the audible threshold of the current noise signal). Moreover, the reference signal z(n) on the line 1514 can also include the useful signal Music(n), which is not essential for the function of the present system. The signal e^(n) generated by filtering β*y(n) with the transfer function S^(z) of the filter 1320, is subtracted from the signal e"(n) to obtain the signal e'(n). This signal e'(n) is converted by the third Fast Fourier Transformation unit 1408 to the signal E'(ω), which is used together with Z(ω) in the LMS unit 1522 for adaptive control of the filter coefficients of the filters 1318, 1320, 1322, 1510 and 1512 with the Least Mean Square algorithm.

The non-acoustic sensor 1403 again generates an electric signal correlated with the noise signal, with which the signal $f_n$(n) is obtained from the calculation unit 1410. The signal generator 1424 generates the input signal x(n) for the filter 1504 corresponding to the noise signal. The second calculation unit 1412 determines the filter coefficients K(n) for the adaptive bandpass filter 1414. Using the first filter 1318 with the transfer function S^(z), the signal x(n) is converted to the signal x'(n) and is then used together with the signal e'(n) filtered through the bandpass filter 1414 for control of the LMS unit 1324 for adaptive control of the filter coefficients of the filter 1504 using the Least Mean Square algorithm. The signal e'(n) is added to the signal derived from the signal $y_{FB}$(n) filtered with the transfer function S^(z) of the filter 1512 to obtain the signal $x_{FB}$(n) on line 1530. The signal $x_{FB}$(n) represents the input signal for the adaptive filter 1506 and is also used after conversion to the signal $x'_{FB}$(n) through the filter 1510 with the transfer function S^(z) together with the signal e'(n) for accessing the LMS circuit 1508 for adaptive control of the filter coefficients of the filter 1506 with the transfer function $W_{FB}$(z) using the Least Mean Square algorithm.

A psychoacoustic mask generation process executed by the Psychoacoustic Masking Model units of FIGS. 13-15 provides an implementation of the psychoacoustic model that simulates the masking effects of human hearing. The masking model used may be based on, e.g., the so-called Johnston Model or the MPEG model as described in the ISO MPEG1 standard. The exemplary implementations shown in FIGS. 16 and 17 use the MPEG model. The psychoacoustic mask modeling processes described herein may be implemented in a signal processor or in any other unit known running such process.

Figure 16:
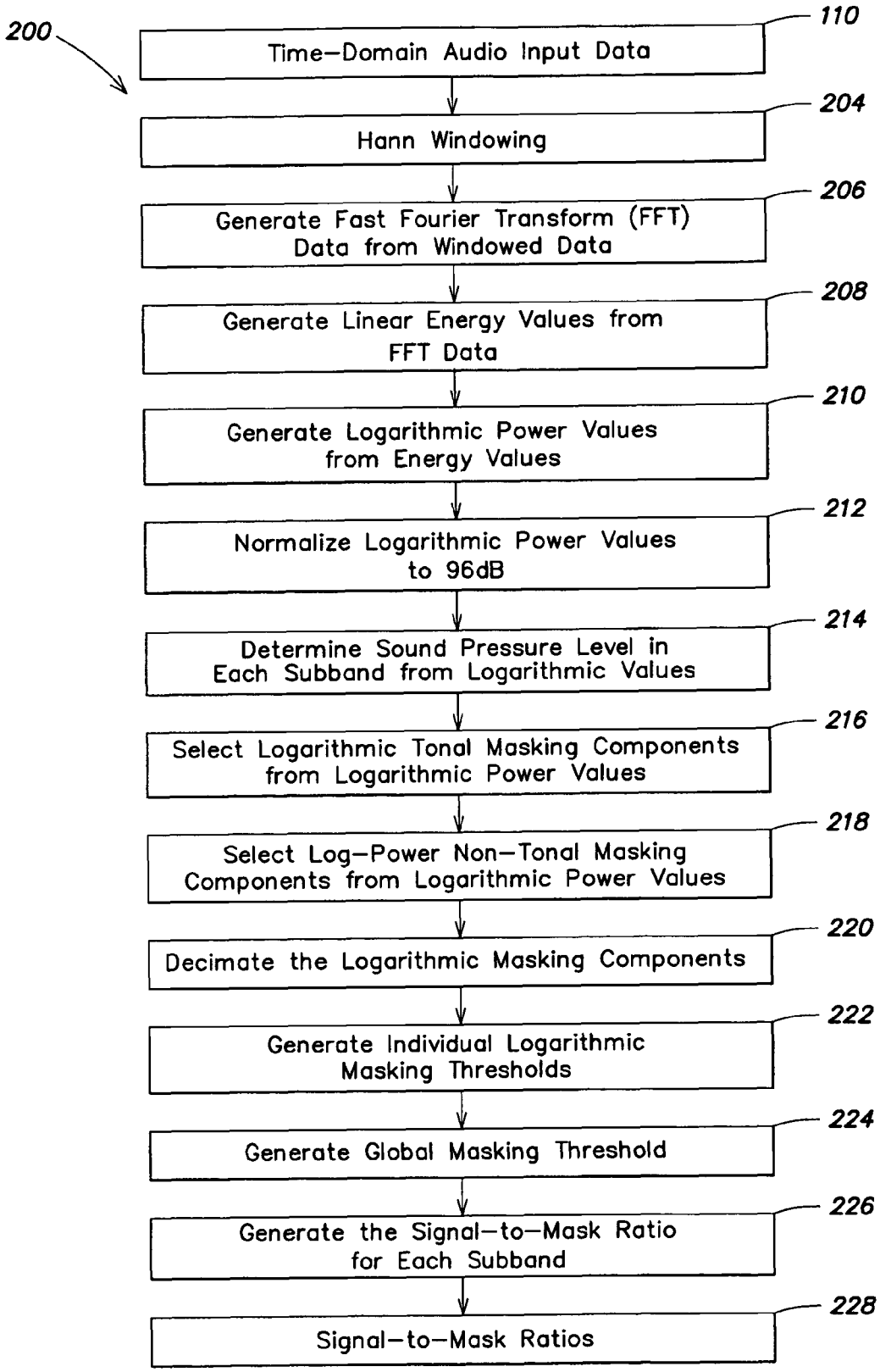
FIG. 16 is a flow diagram of a process implementing the masking model evaluating a linear function.
Figure 17:
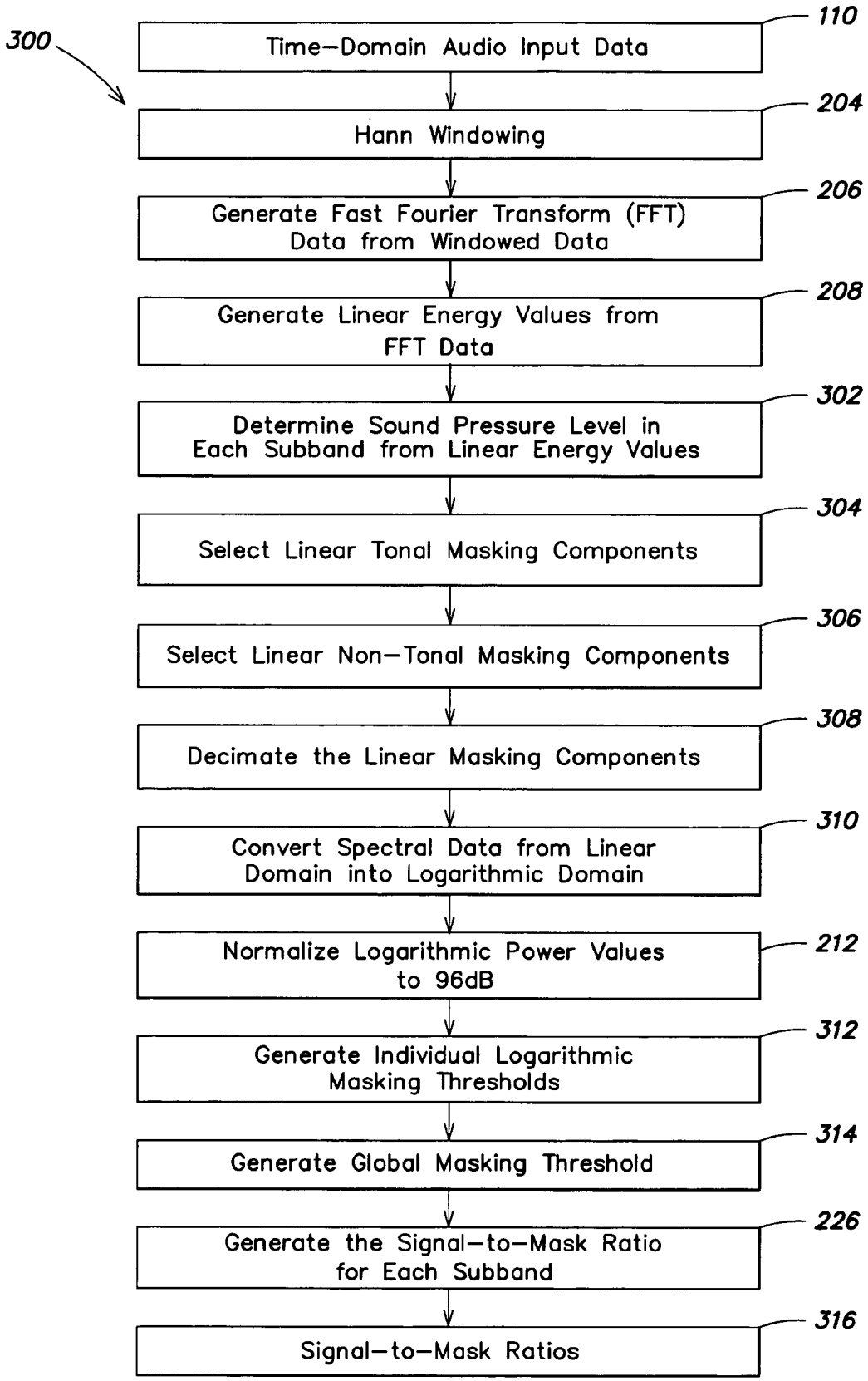
FIG. 17 is a flow diagram of a process implementing the masking model evaluating a logarithmic function.

The psychoacoustic mask modeling processes as shown in FIGS. 16 and 17 begin with Hann windowing the 512-sample time-domain input audio data frame 110 at step 204. The Hann windowing effectively centers the 512 samples between the previous samples and the subsequent samples, using a Hann window to provide a smooth taper. This reduces ringing edge artifacts that would otherwise be produced at step 206 when the time-domain audio data 110 is converted to the frequency domain using a 1024-point fast Fourier transform (FFT). At step 208, an array of 512 energy values for respective frequency sub-bands is then generated from the symmetric array of 1024 FFT output values, according to:

$$E(n)=|X(n)|^2=X_R^2(n)+X_I^2(n),$$

where $X(n)=X_R(n)+iX_I(n)$ is the FFT output of the nth spectral line.

In the following, a value or entity is described as logarithmic or as being in the logarithmic-domain if it has been generated as the result of evaluating a logarithmic function. When a logarithmic value or entity is exponentiated by the reverse operation, it is described as linear or as being in the linear-domain.

In the process shown in FIG. 16, the linear energy values E(n) are then converted into logarithmic power spectral density (PSD) values P(n) at step 210, according to $P(n)=10\log_{10}E(n)$, and the linear energy values E(n) are not used again. The PSD values are normalized to 96 dB at step 212. Steps 210 and 212 are omitted from the mask generation process 300 of FIG. 17.

The next step in both processes is to generate sound pressure level (SPL) values for each sub-band. In the process of FIG. 16, an SPL value $L_{sb}(n)$ is generated for each sub-band n at step 214, according to:

$$L_{spl}(n) = \mathrm{MAX}[X_{spl}(n),\ 20\cdot\log(scf_{max}(n)\cdot 32768) - 10]\ \mathrm{dB}$$

and $$X_{spl}(n) = 10*\log_{10}\left(\sum_k 10^{X(k)/10}\right)\mathrm{dB}$$

where $scf_{max}(n)$ is the maximum of the three scale factors of sub-band n within an MPEG1 L2 audio frame comprising 1152 samples, X(k) is the PSD value of index k, and the summation over k is limited to values of k within sub-band n. The "−10 dB" term corrects for the difference between peak and RMS levels.

In the mask modeling process 300 of FIG. 17, $L_{sb}(n)$ is calculated at step 302, according to:

$$X_{spl}(n) = 10*\log_{10}\left(\sum_k X(k)\right) + 96\ \mathrm{dB}$$

where X(k) is the linear energy value of index k. The "96 dB" term is used in order to normalize $L_{sb}(n)$. It will be apparent that this improves upon the process 200 of FIG. 16 by avoiding exponentiation. Moreover, the efficiency of generating the SPL values is significantly improved by approximating the logarithm by a second order Taylor expansion. Specifically, representing the argument of the logarithm as $I_{pt}$, this is first normalized by determining x such that:

$$I_{pt}=(I-x)2^m,\ 0.5<1-x\leqq 1$$

Using a second order Taylor expansion, $$In(1-x)\approx -x-x^2/2$$

the logarithm can be approximated as:

$$\log_{10}(Ipt) = [m*\ln(2) - (x + x^2/2)]*\log_{10}(e)$$
$$= [m*\ln(2) - (x + x^*x^*0.5)]*\log_{10}(e)$$

Thus the logarithm is approximated by four multiplications and two additions, providing a significant improvement in computational efficiency.

The next step is to identify frequency components for masking. As the tonality of a masking component affects the masking threshold, tonal and non-tonal (noise) masking components are determined separately.

First, local maxima are identified. A spectral line X(k) is deemed to be a local maximum if:

$$X(k)>X(k-1)\text{ and }X(k)\geqq X(k+1)$$

In the process 200 of FIG. 16, a local maximum X(k) thus identified is selected as a logarithmic tonal masking component at step 216 if:

$$X(k)-X(k+j)\geqq 7\ dB$$

where j is a searching range that varies with k. If X(k) is found to be a tonal component, then its value is replaced by:

$$X_{tonal}(k)=10\log_{10}(10^{x(k-1)/10}+10^{x(k)/10}+10^{x(k+1)/10})$$

All spectral lines within the examined frequency range are then set to −∞dB.

In the mask modeling process 300 of FIG. 17, a local maximum X(k) is selected as a linear tonal masking component at step 304 if:

$$X(k)\cdot 10^{-0.7}\geqq X(k+j)$$

If X(k) is found to be a tonal component, then its value is replaced by:

$$X_{tonal}(k)=X(k-1)+X(k)+X(k+1)$$

All spectral lines within the examined frequency range are then set to 0.

The next step in either process is to identify and determine the intensity of non-tonal masking components within the bandwidth of critical sub-bands. For a given frequency, the smallest band of frequencies around that frequency which activate the same part of the basilar membrane of the human ear is referred to as a critical band. The critical bandwidth represents the ear's resolving power for simultaneous tones. The bandwidth of a sub-band varies with the center frequency of the specific critical band. As described in the MPEG-1 standard, 26 critical bands are used for a 48 kHz sampling rate. The non-tonal (noise) components are identified from the spectral lines remaining after the tonal components are removed as described above.

At step 218 of the process 200 of FIG. 16, the logarithmic powers of the remaining spectral lines within each critical band are converted to linear energy values, summed and then converted back into a logarithmic power value to provide the SPL of the new non-tonal component $X_{noise}(k)$ corresponding to that critical band. The number k is the index number of the spectral line nearest to the geometric mean of the critical band.

In the mask modeling process 300 of FIG. 17, the energy of the remaining spectral lines within each critical band are summed at step 306 to provide the new non-tonal component $X_{noise}(k)$ corresponding to that critical band:

$$X_{noise}(k) = \sum_k X(k)$$

for k in sub-band n. Only addition operations are used, and no exponential or logarithmic evaluations are required, providing a significant improvement in efficiency.

The next step is to decimate the tonal and non-tonal masking components. Decimation is a procedure that is used to reduce the number of masking components that are used to generate the global masking threshold.

In the process 200 of FIG. 16, logarithmic components $X_{tonal}(k)$ and non-tonal components $X_{noise}(k)$ are selected at step 220 for subsequent use in generating the masking threshold only if:

$$X_{tonal}(k) \geqq LT_q(k) \text{ or } X_{noise}(k) \geqq LT_q(k)$$

respectively, where LTq(k) is the absolute threshold (or threshold in quiet) at the frequency of index k; threshold in quiet values in the logarithmic domain are provided in the MPEG-1 standard.

Decimation is performed on two or more tonal components that are within a distance of less than 0.5 Bark, where the Bark scale is a frequency scale on which the frequency resolution of the ear is approximately constant, as described above (see also E. Zwicker, Subdivision of the Audible Frequency Range into Critical Bands, J. Acoustical Society of America, vol. 33, p. 248, February 1961). The tonal component with the highest power is kept while the smaller component(s) are removed from the list of selected tonal components. For this operation, a sliding window in the critical band domain is used with a width of 0.5 Bark.

In the mask modeling process 300 of FIG. 17, linear components are selected at step 308 only if:

$$X_{tonal}(k) \geqq LT_qE(k) \text{ or } X_{noise}(k) \geqq LT_qE(k)$$

where $LT_qE(k)$ are taken from a linear-domain absolute threshold table pre-generated from the logarithmic domain absolute threshold table $LT_q(k)$ according to:

$$LT_qE(k)=10^{\log_{10}[LTq(k)-96]/10}$$

where the "−96" term represents denormalization.

After denormalization, the spectral data in the linear energy domain are converted into the logarithmic power domain at step 310. In contrast to step 206 of the prior art process, the evaluation of logarithms is performed using the efficient second-order approximation method described above. This conversion is followed by normalization to the reference level of 96 dB at step 212.

Having selected and decimated masking components, the next step is to generate individual masking thresholds. Of the original 512 spectral data values, indexed by k, only a subset, indexed by i, is subsequently used to generate the global masking threshold, and the present step determines that subset by subsampling, as described in the ISO MPEG1 standard.

The number of lines n in the subsampled frequency domain depends on the sampling rate. For a sampling rate of 48 kHz, n=126. Every tonal and non-tonal component is assigned an index i that most closely corresponds to the frequency of the corresponding spectral line in the original (i.e., before subsampling) spectral data.

The individual masking thresholds of both tonal and non-tonal components, $LT_{tonal}$ and $LT_{noise}$, are then given by the following expressions:

$$LT_{tonal}[z(j),z(i)]=X_{tonal}[z(j)]+av_{tonal}[z(j)]+vf[z(j),z(i)] \text{ dB}$$

$$LT_{noise}[z(j),z(i)]=X_{noise}[z(j)]+av_{noise}[z(j)]=vf[z(j),z(i)] \text{ dB}$$

where i is the index corresponding to a spectral line, at which the masking threshold is generated and j is that of a masking component; z(i) is the Bark scale value of the $i^{th}$ spectral line while z(j) is that of the $j^{th}$ line; and terms of the form X[z(j)] are the SPLs of the (tonal or non-tonal) masking component. The term av, referred to as the masking index, is given by:

$$av_{tonal}=[-1.525-0.275\cdot z(j)-4.5]\text{dB}$$

$$av_{noise}=[-1.525-0.175\cdot z(j)-0.5]\text{dB}$$

vf is a masking function of the masking component and comprises different lower and upper slopes, depending on the distance in Bark scale dz, dz=z(i)−z(i).

In the process 200 of FIG. 16, individual masking thresholds are calculated at step 222 using a masking function vf given by:

$$vf=17\cdot(dz+1)-0.4\cdot X[z(j)]-6 \text{ dB, for } -3\leqq dz<-1 \text{ Bark}$$

$$vf=\{0.4\cdot X[z(j)]+6\}\cdot dz \text{ dB, for } -1\leqq dz<0 \text{ Bark}$$

$$vf=-17\cdot dz \text{ dB, for } 0\leqq dz<1 \text{ Bark}$$

$$vf=-17\cdot dz+0.15\cdot X[z(j)]v(dz-1) \text{ dB, for } 1\leqq dz<8 \text{ Bark}$$

where X[z(j)] is the SPL of the masking component with index j. No masking threshold is generated if dz<−3 Bark, or dz>8 Bark.

The evaluation of the masking function vf is the most computationally intensive part of this step. The masking function can be categorized into two types: downward masking (when dz<0) and upward masking (when dz≧0) where downward masking is considerably less significant than upward masking. Consequently, only upward masking is used in the mask generation process 300 of FIG. 17. Further analysis shows that the second term in the masking function for 1≦dz<8 Bark is typically approximately one tenth of the first term, −17·dz. Consequently, the second term may be discarded.

Accordingly, the mask generation process 300 of FIG. 17 generates individual masking thresholds at step 312 using a single expression for the masking function vf, as follows:

$$vf=-17\cdot dz,\ 0\leqq dz<8$$

The masking index av is not modified from that used in the process 200 of FIG. 16, because it makes a significant contribution to the individual masking threshold $L_T$ and is not computationally demanding. After the individual masking thresholds have been generated, a global masking threshold is generated.

In the process 200 of FIG. 16, the global masking threshold LTg(i) at the $i^{th}$ frequency sample is generated at step 224 by summing the powers corresponding to the individual masking thresholds and the threshold in quiet, according to:

$$LT_g(i) = 10\log_{10}\left[10^{LT_q(i)/10}+\sum_{j=1}^{m}10^{LT_{tonal}[z(j),z(i)]/10}+\sum_{j=1}^{n}10^{LT_{noise}[z(j),z(i)]/10}\right]$$

where m is the total number of tonal masking components, and n is the total number of non-tonal masking components. The threshold in quiet $LT_q$ is offset by −12 dB for bit rates ≧96 kbps per channel. It will be apparent that this step is computationally demanding due to the number of exponentials and logarithms that are evaluated.

In the mask generation process 300 of FIG. 17, these evaluations are avoided and smaller terms are not used. The global marking threshold $LT_g(i)$ at the $i^{th}$ frequency sample is generated at step 314 by comparing the powers corresponding to the individual masking thresholds and the threshold in quiet, as follows:

$$LT_g(i)=\max[LT_q(i)+\max_{j=1}^{m}\{LT_{tonal}[z(j),z(i)]\}+\max_{j=1}^{n}\{LT_{noise}[z(j),z(i)]\}]$$

The largest tonal masking components $LT_{tonal}$ and non-tonal masking components $LT_{noise}$ are identified. They are then compared with $LT_{qx}(i)$. The maximum of these three values is selected as the global masking threshold at the $i^{th}$ frequency sample. This reduces computational demands of occasional over allocation. As above, the threshold in quiet $LT_q$ is offset by −12 dB for bit rates ≧96 kbps per channel.

Finally, signal-to-mask ratio values are calculated at step 226 of both processes. First, the minimum masking level $LT_{min}(n)$ in sub-band n is determined by the following expression:

$$LT_{min}(n)=\mathrm{Min}[LTg(i)]\mathrm{dB};\ f \text{ or } f(i) \text{ in subband } n,$$

where f(i) is the $i^{th}$ frequency line within sub-band n. A minimum masking threshold $LT_{min}(n)$ is determined for every sub-band. The signal-to-mask ratio for every sub-band n is then generated by subtracting the minimum masking threshold of that sub-band from the corresponding SPL value:

$$SM_{sb}(n)=L_{sb}(n)-LT_{min}(n)$$

The mask model sends the signal-to-mask ratio data SMRsb (n) for each sub-band n to a quantizer, which uses it to determine how to most effectively allocate the available data bits and quantize the spectral data, as described in the MPEG-1 standard.

The beneficial effect in the examples above is derived from the consideration of the currently available noise level and its spectral attributes in the passenger area of an automobile, for which the test signal for determination of the transfer function of the secondary path is selected in such a way that it is inaudible to the passengers. The existing noise level can comprise unwanted obtrusive signals, such as wind disturbances, wheel-rolling sounds and undesirable noise, such as an acoustically modeled engine noise and, in some cases, simultaneously relayed music signals. Use is made of the effect that inaudible information can be added to any given audio signal if the relevant psychoacoustic requirements are satisfied. The case presented here refers in particular to the psychoacoustic effects of masking.

Further benefits can be derived from the aspect that the method of psychoacoustic masking responds adaptively to the current noise level, and that audio signals (such as music) at the same time are not necessary in order to obtain the desired masking effect.

Although various examples to realize the invention have been disclosed, it will be apparent to those skilled in the art that various changes and modifications can be made which will achieve some of the advantages of the invention without departing from the spirit and scope of the invention. It will be obvious to those reasonably skilled in the art that other components performing the same functions may be suitably substituted. Such modifications to the inventive concept are intended to be covered by the appended claims.

What is claimed is:

1. A system for active control of an unwanted noise signal at a listening site radiated by a noise source where the unwanted noise is transmitted to the listening site via a primary path having a primary path transfer function, the system comprising:

a loudspeaker for radiating a cancellation signal to attenuate the unwanted noise signal, where the cancellation signal is transmitted from the loudspeaker to the listening site via a secondary path;

an microphone at the listening site for determining through an error signal the level of achieved reduction;

a first adaptive filter for generating the canceling signal by filtering a signal representative of the unwanted noise signal with a transfer function adapted to the primary path transfer function using the signal representative of the unwanted noise signal and the error signal from the microphone; and a reference generator for generating a reference signal which is supplied to the loudspeaker together with the canceling signal from the first adaptive filter, where the reference signal has at least one of an amplitude and a frequency such that the reference signal is masked for a human listener at the listening site by a wanted signal present at the listening site.

2. A system for active control of an unwanted noise signal at a listening site radiated by a noise source where the unwanted noise is transmitted to the listening site via a primary path having a primary path transfer function, the system comprising:

a loudspeaker for radiating a cancellation signal to attenuate the unwanted noise signal, where the cancellation signal is transmitted from the loudspeaker to the listening site via a secondary path;

an microphone at the listening site for determining through an error signal the level of achieved reduction;

a first adaptive filter for generating the canceling signal by filtering a signal representative of the unwanted noise signal with a transfer function adapted to the primary path transfer function using the signal representative of the unwanted noise signal and the error signal; and a reference generator for generating a reference signal which is supplied to the loudspeaker together with the canceling signal from the first adaptive filter, where the reference signal has at least one of an amplitude and a frequency such that the reference signal is masked for a human listener at the listening site by at least one of the unwanted noise signal and a wanted signal present at the listening site, and where the at least one of the amplitude and the frequency of the reference signal are determined by a psychoacoustic masking model unit which models masking in human hearing in the error signal.

3. The system of claim 2, where the psychoacoustic masking model unit models temporal masking.

4. The system of claim 2, where the psychoacoustic masking model unit models spectral masking.

5. The system of claim 2 , where the psychoacoustic masking model unit is operated in the frequency domain.

6. The system of claim 1, where the first adaptive filter adapts according to a Least Mean Square (LMS) algorithm.

7. The system of claim 1, where the first adaptive filter adapts according to a filtered X Least Mean Square (filtered x-LMS) algorithm.

8. A system for active control of an unwanted noise signal at a listening site radiated by a noise source where the unwanted noise is transmitted to the listening site via a primary path having a primary path transfer function, the system comprising:

a loudspeaker for radiating a cancellation signal to attenuate the unwanted noise signal, where the cancellation signal is transmitted from the loudspeaker to the listening site via a secondary path;

an microphone at the listening site for determining through an error signal the level of achieved reduction;

a first adaptive filter for generating the canceling signal by filtering a signal representative of the unwanted noise signal with a transfer function adapted to the primary path transfer function using the signal representative of the unwanted noise signal and the error signal;

a reference generator for generating a reference signal which is supplied to the loudspeaker together with the canceling signal from the first adaptive filter, where the reference signal has at least one of an amplitude and a frequency such that the reference signal is masked for a human listener at the listening site by at least one of the unwanted noise signal and a wanted signal present at the listening site; and a second adaptive filter having a transfer function modeling the transfer function of the secondary path, where the second adaptive filter is connected to the first adaptive filter for filtering the signal representative of the unwanted noise signal used for the adaptation of the first adaptive filter.

9. The system of claim 8, where the second adaptive filter adapts according to a Least Mean Square (LMS) algorithm.

10. The system of claim 8, where the signal representative of the unwanted noise signal supplied to the first adaptive filter is derived from the error signal and the signal output by the first adaptive filter and filtered by a third adaptive filter having a transfer function modeling the transfer function of the secondary path.

11. The system of claim 10, where the signal representative of the unwanted noise signal supplied to the first adaptive filter is derived further from the reference signal filtered with a fourth adaptive filter having a transfer function modeling the transfer function of the secondary path.

12. The system of claim 11, where the fourth filter is operated in the frequency domain, and a time-to-frequency converter is connected upstream of the fourth filter and a frequency-to-time converter is connected downstream of the fourth filter.

13. The system of claim 1, where the signal representing the unwanted noise signal supplied to the first adaptive filter is derived from a non-acoustic sensor and the non-acoustic sensor provides a sensor signal and is arranged near the unwanted-noise source.

14. The system of claim 13, further comprising:

a fundamental calculation unit connected downstream of the non-acoustic sensor for calculating a fundamental signal from the sensor signal; and a signal generator connected downstream of the fundamental calculation unit for generating the signal representative of the unwanted noise signal from the fundamental signal.

15. The system of claim 14, further comprising a band pass filter having filter coefficients for filtering the error signal supplied to the first adaptive filter, where the filter coefficients are controlled by a coefficient calculation unit connected downstream of the fundamental calculation unit.

16. The system of claim 14, where the reference signal includes the wanted signal provided by a wanted-signal source.

17. The system of claim 1, where the signal output by the first adaptive filter is split into at least two partial signals multiplied with weighting factors, where one of the partial signals is supplied to the loudspeaker and an other is supplied to a second adaptive filter modeling the secondary path whose output signal is added to the error signal.

18. The system of claim 17, where the sum of the weighting factors is equal to one.

19. The system of claim 17, further comprising a third adaptive filter for modeling the primary path, where the third adaptive filter provides an output signal supplied to the loudspeaker and being supplied with the sum of its output signal and the reference signal.

20. A method for active control of an unwanted noise signal at a listening site radiated by a noise source where the unwanted noise is transmitted to the listening site via a primary path having a primary path transfer function, the method comprising:

radiating a cancellation signal to reduce or cancel the unwanted noise signal, where the cancellation signal is transmitted from a loudspeaker to the listening site via a secondary path;

determining through an error signal the level of achieved reduction at the listening site;

first adaptive filtering for generating the canceling signal by filtering a signal representative of the unwanted noise signal with a transfer function adapted to the primary path transfer function using the signal representative of the unwanted noise signal and the error signal; and generating a reference signal which is supplied to the loudspeaker together with the canceling signal from the first adaptive filtering step, where the reference signal has at least one of an amplitude and a frequency such that the reference signal is masked for a human listener at the listening site by a wanted signal present at the listening site.

21. A method for active control of an unwanted noise signal at a listening site radiated by a noise source where the unwanted noise is transmitted to the listening site via a primary path having a primary path transfer function, the method comprising:

radiating a cancellation signal to reduce or cancel the unwanted noise signal, where the cancellation signal is transmitted from a loudspeaker to the listening site via a secondary path;

determining through an error signal the level of achieved reduction at the listening site;

first adaptive filtering for generating the canceling signal by filtering a signal representative of the unwanted noise signal with a transfer function adapted to the primary path transfer function using the signal representative of the unwanted noise signal and the error signal; and generating a reference signal which is supplied to the loudspeaker together with the canceling signal from the first adaptive filtering step, where the reference signal has at least one of an amplitude and a frequency such that the reference signal is masked for a human listener at the listening site by at least one of the unwanted noise signal and a wanted signal present at the listening site;

where the at least one of the amplitude and the frequency of the reference signal are determined by a psychoacoustic masking modeling step which models masking in human hearing in the error signal.

22. The method of claim 21, where the psychoacoustic masking modeling step models temporal masking.

23. The method of claim 21, where the psychoacoustic masking modeling step models spectral masking.

24. The method of claim 21, where the psychoacoustic masking modeling step is performed in the frequency domain.

25. The method of claim 20, where the first adaptive filtering step adapts according to a Least Mean Square (LMS) algorithm.

26. The method of claim 25, where the first adaptive filtering step adapts according to a filtered X Least Mean Square (filtered x-LMS) algorithm.

27. A method for active control of an unwanted noise signal at a listening site radiated by a noise source where the unwanted noise is transmitted to the listening site via a primary path having a primary path transfer function, the method comprising:

radiating a cancellation signal to reduce or cancel the unwanted noise signal, where the cancellation signal is transmitted from a loudspeaker to the listening site via a secondary path;

determining through an error signal the level of achieved reduction at the listening site;

first adaptive filtering for generating the canceling signal by filtering a signal representative of the unwanted noise signal with a transfer function adapted to the primary path transfer function using the signal representative of the unwanted noise signal and the error signal;

generating a reference signal which is supplied to the loudspeaker together with the canceling signal from the first adaptive filtering step, where the reference signal has at least one of an amplitude and a frequency such that the reference signal is masked for a human listener at the listening site by at least one of the unwanted noise signal and a wanted signal present at the listening site; and second adaptive filtering the signal representative of the unwanted noise signal used for the adaptation of the first adaptive filtering using a transfer function modeling the transfer function of the secondary path.

28. The method of claim 27, where the second adaptive filter adapts according to the Least Mean Square (LMS) algorithm.

29. The method claim 20, where the signal representative of the unwanted noise signal used in the first adaptive filtering step is derived from the error signal and the signal output by the first adaptive filtering step and filtered in a second adaptive filtering step having a transfer function modeling the transfer function of the secondary path.

30. The method of claim 29, where the signal representative of the unwanted noise signal used in the first adaptive filtering step is derived further from the reference signal filtered in a third adaptive filtering step having a transfer function modeling the transfer function of the secondary path.

31. A method for active control of an unwanted noise signal at a listening site radiated by a noise source where the unwanted noise is transmitted to the listening site via a primary path having a primary path transfer function, the method comprising:

radiating a cancellation signal to reduce or cancel the unwanted noise signal, where the cancellation signal is transmitted from a loudspeaker to the listening site via a secondary path;

determining through an error signal the level of achieved reduction at the listening site;

first adaptive filtering for generating the canceling signal by filtering a signal representative of the unwanted noise signal with a transfer function adapted to the primary path transfer function using the signal representative of the unwanted noise signal and the error signal; and generating a reference signal which is supplied to the loudspeaker together with the canceling signal from the first adaptive filtering step, where the reference signal has at least one of an amplitude and a frequency such that the reference signal is masked for a human listener at the listening site by at least one of the unwanted noise signal and a wanted signal present at the listening site;

where the signal representative of the unwanted noise signal used in the first adaptive filtering step is derived from the error signal and the signal output by the first adaptive filtering step and filtered in a second adaptive filtering step having a transfer function modeling the transfer function of the secondary path;

where the signal representative of the unwanted noise signal used in the first adaptive filtering step is derived further from the reference signal filtered in a third adaptive filtering step having a transfer function modeling the transfer function of the secondary path; and where the third filtering step is performed in the frequency domain, and the third filtering step includes a time-to-frequency conversion step in advance to and a frequency-to-time conversion step following the third filtering step.

32. The method of claim 20, where the signal representing the unwanted noise signal used in the first adaptive filtering step is derived from a non-acoustic sensor, and the non-acoustic sensor provides a sensor signal and is arranged near the unwanted-noise source.

33. The method of claim 32, further comprising a fundamental calculation step for calculating a fundamental signal from the sensor signal and a signal generation step for generating the signal representative of the unwanted noise signal from the fundamental signal.

34. The method of claim 33, further comprising a band pass filtering step using filter coefficients for filtering the error signal used in the first adaptive filtering step, where the filter coefficients are controlled by a coefficient calculation step using the fundamental signal.

35. The method of claim 34, where the reference signal includes the wanted signal provided by a wanted-signal source.

36. The method of claim 20, where the signal output by the first adaptive filtering step is split into at least two partial signals multiplied with weighting factors, where one of the partial signals is supplied to the loudspeaker and another is used by a fifth adaptive filtering step modeling the secondary path whose output signal is added to the error signal.

37. The method of claim 36, where the sum of the weights is one.

38. The method of claim 20, further comprising a sixth adaptive filtering step for modeling the primary path, where the sixth adaptive filtering step provides an output signal supplied to the loudspeaker and being input with the sum of its output signal and the reference signal.

* * * * *

UNITED STATES PATENT AND TRADEMARK OFFICE

CERTIFICATE OF CORRECTION

PATENT NO. : 8,199,923 B2
APPLICATION NO. : 12/015219
DATED : June 12, 2012
INVENTOR(S) : Markus Christoph It is certified that error appears in the above-identified patent and that said Letters Patent is hereby corrected as shown below:

Column 16
Line 38, please add the following paragraph before the paragraph which begins "In the system of FIG. 14...":

--The system of FIG. 14 includes the system of FIG. 13 and, further, a third FFT unit 1408 for Fast Fourier Transformations of signals from the time domain to the frequency domain, a first calculation circuit 1410 and a second calculation circuit 1412. The system of FIG. 14 also features in addition to the system of FIG. 13 an adaptive bandpass filter 1414 and, as already mentioned above, the non-acoustic sensor 1403.--

Signed and Sealed this
Thirty-first Day of July, 2012

David J. Kappos

David J. Kappos
*Director of the United States Patent and Trademark Office*